US007667149B2

(12) United States Patent
Komori et al.

(10) Patent No.: US 7,667,149 B2
(45) Date of Patent: Feb. 23, 2010

(54) SAFETY SWITCH

(75) Inventors: Etsurou Komori, Osaka (JP); Takao Fukui, Osaka (JP); Takeo Yasui, Osaka (JP); Masaki Nobuhiro, Osaka (JP)

(73) Assignee: IDEC Corporation, Osaka (JP)

( * ) Notice: Subject to any disclaimer, the term of this patent is extended or adjusted under 35 U.S.C. 154(b) by 108 days.

(21) Appl. No.: 11/919,592

(22) PCT Filed: Apr. 26, 2006

(86) PCT No.: PCT/JP2006/308714

§ 371 (c)(1),
(2), (4) Date: Oct. 29, 2007

(87) PCT Pub. No.: WO2006/120902

PCT Pub. Date: Nov. 16, 2006

(65) Prior Publication Data

US 2009/0065340 A1 Mar. 12, 2009

(30) Foreign Application Priority Data

May 11, 2005 (JP) ..... 2005-138212

(51) Int. Cl.
*H01H 27/00* (2006.01)

(52) U.S. Cl. ..... 200/43.04; 200/43.01

(58) Field of Classification Search ..... 200/43.01, 200/43.04, 43.09, 17 R
See application file for complete search history.

(56) References Cited

U.S. PATENT DOCUMENTS 5,777,284 A 7/1998 Mohtasham
6,194,674 B1 2/2001 Fukui
6,307,167 B1 * 10/2001 Kajio et al. ..... 200/43.11
6,310,305 B1 10/2001 Kamino et al.

(Continued)

FOREIGN PATENT DOCUMENTS

JP 62-40522 10/1987

(Continued)

OTHER PUBLICATIONS

U.S. Appl. No. 11/919,375, filed Oct. 25, 2007, Komori, et al.

*Primary Examiner*—Kyung Lee
(74) *Attorney, Agent, or Firm*—Jordan and Hamburg LLP

(57) ABSTRACT

A safety switch is provided which is increased in durability and which offers a high degree of freedom of mounting the safety switch to place.

A switch body has a rectangular solid shape. An actuator entrance hole is formed at one of the opposite corner portions of the switch body whereas a cable lead-out port is formed at the other corner portion, whereby the safety switch is increased in the degree of mounting freedom. Thus is offered a wider choice of place to mount the safety switch. The switch body is formed with only one actuator entrance hole so that the safety switch is prevented from suffering failure caused by foreign substances invading through an actuator entrance hole left unused. In addition, a driving cam may be formed with an engaging portion and a cam curve portion in spaced relation so that the driving cam is configured to be free from an area having poor strength. Thus, the driving cam is increased in strength. This leads to the increased durability of the safety switch.

10 Claims, 12 Drawing Sheets

U.S. PATENT DOCUMENTS

| | | | | |
|---|---|---|---|---|
| 6,627,827 | B2 * | 9/2003 | Kiong Low et al. | 200/47 |
| 2003/0005732 | A1 | 1/2003 | Moriyama et al. | |
| 2009/0065340 | A1 | 3/2009 | Komori et al. | |

FOREIGN PATENT DOCUMENTS

| | | |
|---|---|---|
| JP | 3-50733 | 5/1991 |
| JP | 06-076675 | 3/1994 |
| JP | 7-254332 | 10/1995 |
| JP | 07-254332 | 10/1995 |
| JP | 9-245584 | 9/1997 |
| JP | 10-334772 | 12/1998 |
| JP | 2002-140962 | 5/2002 |
| JP | 2002-367470 | 12/2002 |
| JP | 2003-045294 | 2/2003 |
| JP | 2003-45294 | 2/2003 |
| JP | 2003-331696 | 11/2003 |
| JP | 2005-38664 | 2/2005 |
| JP | 2005-038664 | 2/2005 |

* cited by examiner

FIG. 6A: NORMALLY-OPEN SWITCH : UNLOCK POSITION
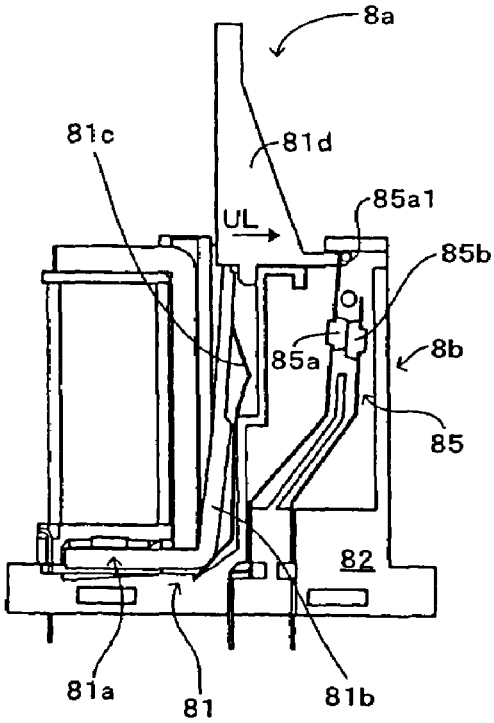
FIG. 6B: NORMALLY-OPEN SWITCH : LOCK POSITION
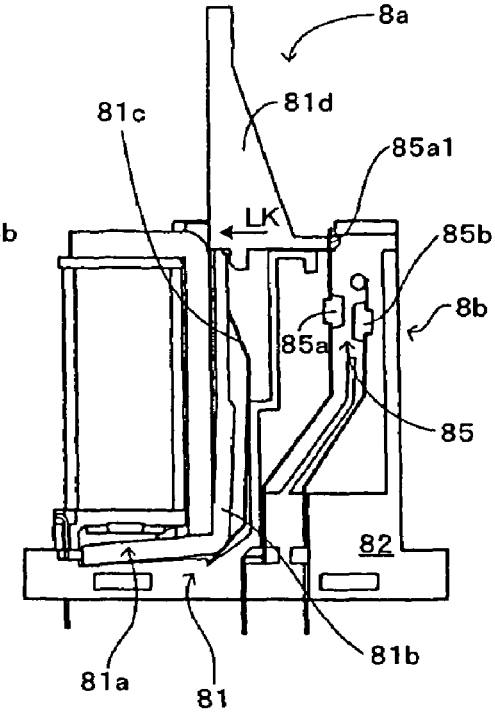
FIG. 6C: NORMALLY-CLOSED SWITCH : UNLOCK POSITION
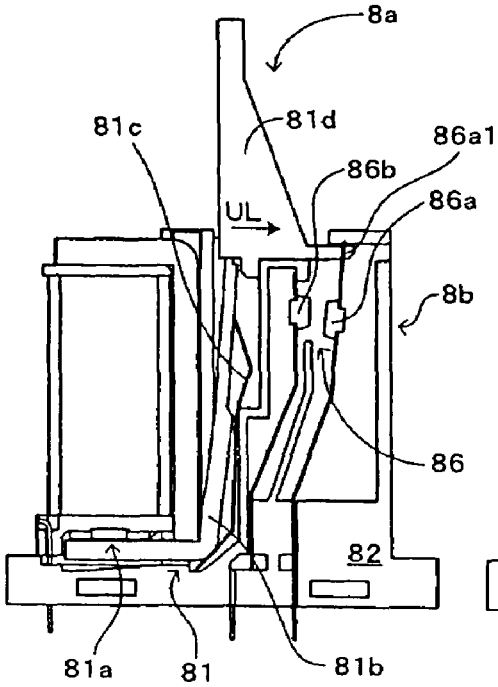
FIG. 6D: NORMALLY-CLOSED SWITCH : LOCK POSITION
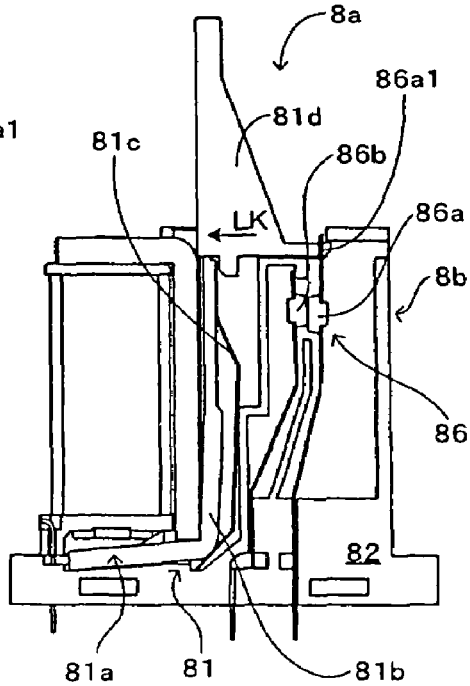

SAFETY SWITCH

BACKGROUND OF THE INVENTION

The present invention relates to a safety switch which is attached to a wall surface around a protection door to industrial machines, for example, and which is designed to cut off power supply to the industrial machines when the protective door is opened.

Conventionally, the safety switch is installed at the protective door to the industrial machines or the like in order to avoid a trouble wherein a worker is injured by being accidentally caught in a working machine. The safety switch is designed to disable the machines when the protective door is not completely closed. One example of such a safety switch is disclosed in, for example, Patent Document 1.

The safety switch is electrically connected with the industrial machines via a cable 610. As shown in FIG. 12A, the safety switch comprises a switch body 100 and an actuator 300.

The switch body 100 comprises an operation portion 500 and a switch portion 700 and is fixedly attached to a wall surface (not shown) around the protective door to the industrial machines. The actuator 300 is secured to the protective door and is located at place opposite either one of insertion holes (entrance holes) 900*a*, 900*b* formed at an upper side or a lateral side of the operation portion 500 such that the actuator may enter into the insertion hole 900*a*, 900*b* while the protective door is closed. As shown in FIG. 12A, the actuator 300 comprises: a base 300*a*; a pair of pressing pieces 300*b* projecting from the base 300*a*; and a connecting piece 300*c* interconnecting these pressing pieces 300*b*. In this case, the pressing pieces 300*b* is configured to have a small width and a great thickness and to define a U-shaped section through the connecting piece 300*c*.

The switch portion 700 is constituted such that a switching device and an operating rod 211 are disposed in a case member 330. A lower outside surface SO of the case member is formed with a cable lead-out port 330*a*. The cable 610 connected with the switching device and the like in the switch portion 700 is led out through the lead-out port so as to be connected with the industrial machines and the like. As shown in FIG. 12A, an outside surface of the case member 330 is formed with a pair of receiving holes 330*b* through which bolts are inserted to mount the switch body 100 to the wall surface around the protective door to the industrial machines. A constitution is made such that a case member 110 of the operation portion 500 is removably attached to the case member 330 by means of an engaging claw or the like.

The operation portion 500 is constituted such that a driving cam 151 rotatably supported by a rotary shaft 131 axially supported by an inside surface of the case member 110 is disposed in the case member 110. An upper part of an outer periphery of the driving cam 151 is formed with two recesses (engaging portions) 151*a*1, 151*a*2 in which the connecting piece 300*c* of the actuator 300 is fittingly inserted. The recesses are formed at such positions as to be exposed to outside through the aforesaid insertion holes 900*a*, 900*b*. A lower part of the outer periphery of the driving cam 151 is formed with a cam curve portion 151*c* including a greater diameter portion and a smaller diameter portion. The operating rod 211 is constituted such that a tip portion thereof is free to project from or retract into the switch portion 700. The operating rod 211 is biased by a coil spring or the like in a direction of an UP-pointing arrow, so that the semi-spherical tip of the operating rod projects into the operation portion 500 to make sliding contact with the cam curve portion 151*c* of the driving cam 151.

The actuator 300 is advanced into the insertion hole 900*a* or 900*b* of the operation portion 500 by closing the protective door, so that the connecting piece 300*c* of the actuator 300 is fittingly inserted into the recess 151*a*1 or 151*a*2 of the driving cam 151. As the actuator 300 in fittingly inserted relation with the driving cam is advanced further into the operation portion 500, the driving cam 151 is rotated in a direction of an arrow α in FIG. 12B. Thus, the operating rod 211 slides on the driving cam 151 from the greater diameter portion to the smaller diameter portion of the cam curve portion 151*c*, so that the operating rod 211 moves in the direction of the UP-pointing arrow to shift the switching device of the switch portion 700 between on and off states.

Another example of the conventional safety switch is shown in FIG. 13A. As shown in the figure, the safety switch has a constitution wherein actuator insertion holes 900*c*, 900*d* are collectively formed at one corner portion of the case member 110 constituting the operation portion 500. In this case, a driving cam 152 rotatably supported by a rotary shaft 132 pivotally mounted to the inside surface of the case member 110 is disposed in the operation portion 500 of the switch body 101, as shown in FIG. 13B. An upper part of an outer periphery of the driving cam 152 is formed with a recess (engaging portion) 152*a* in which the connecting piece 300*c* of the actuator 300 is fittingly inserted. The recess is formed at such a position as to be exposed to outside through the aforesaid insertion holes 900*c*, 900*d*. Cam curve portions 152*c*1, 152*c*2, each including greater and smaller diameter portions, are formed at a lower part of the outer periphery of the driving cam 152. Similarly to the above safety switch, a semi-spherical tip of an operating rod 212 makes sliding contact with the cam curve portions 152*c*1, 152*c*2 of the driving cam 152. It is noted here that the cam curve portions 152*c*1, 152*c*2 comprise the cam curve portions 151*c* shown in FIG. 12B arranged in transversely symmetrical relation. As compared with the example of FIG. 12B, the example of FIG. 13B includes only one recess but two cam curve portions.

In a case where the actuator 300 enters into the operation portion 500 through the insertion hole 900*c* of the operation portion 500, the driving cam 152 is rotated in the direction of the arrow α in FIG. 13B. In a case where the actuator 300 enters into the operation portion 500 through the insertion hole 900*d*, the driving cam 152 is rotated in a direction of an arrow β in FIG. 13B. In this manner, the driving cam 152 is rotated in the direction of arrow α or arrow β, whereby the operating rod 212 slides on the driving cam 152 from the greater diameter portion to the smaller diameter portion of the cam curve portion 152*c*1, 152*c*2, so that the operating rod 212 moves in the direction of the UP-pointing arrow to shift the switching device of the switch portion 700 between the on and off states.

Patent Document 1: Japanese Unexamined Patent Publication No. 2002-140962 (Paragraphs [0040] to [0044], FIG. 1)

SUMMARY OF THE INVENTION

Problems to Be Solved by the Invention

By the way, the above conventional safety switches are provided with the two actuator entrance holes (insertion holes) at the operation portion in order to increase the freedom of mounting direction, position and such of the safety switch thereby allowing for a wider choice of place to mount the safety switch. This involves a problem that measure against the invasion of foreign substances into the safety switch must be taken. For instance, a cover must be attached to the actuator entrance hole left unused in order to prevent the safety switch from suffering failure caused by the foreign substances invading through the unused actuator entrance hole.

In order to receive the actuator 300 advanced into the operation portion 500 from each of the two directions, it is necessary to provide the two engaging portions (recesses) 151*a*1, 151*a*2 at the driving cam 151, as shown in FIG. 12B or to provide the two cam curve portions 152*c*1, 152*c*2 at the driving cam 152, as shown in FIG. 13B. Hence, the engaging portion and the cam curve portion are located in closely spaced relation as illustrated by an area A1 enclosed by a dot-dash line in the driving cam 151 (FIG. 12B) or by an area B2 enclosed by a dot-dash line in the driving cam 152 (FIG. 13B). That is, a problem exists that the driving cams 151, 152 are detrimentally configured to include an area having a poor strength.

When the safety switch is installed on the wall surface or the like and the cable 610 led out through the cable lead-out port 330*a* is connected to the industrial machines or the like disposed externally of the safety switch, the cable 610 must be bent for installing the cable 610. At this time, the cable 610 is bent at an angle CA of about 90°. As shown in FIG. 12A and FIG. 13A, the cable 610 protrudes outwardly from the safety switch by a length W. Accordingly, a space corresponding to the length of the cable protrusion must be provided to allow for the bending of the cable 610. This results in a problem that the location of the safety switch is limited.

In view of the foregoing problems, the invention seeks to provide a safety switch which is increased in durability and which offers a higher degree of freedom of mounting the safety switch to place.

According to the invention for achieving the above object, a safety switch comprising a switch body removably attachable to a fixing member, an actuator free to enter or retreat from an operation portion of the switch body is provided, a driving cam free to rotate in the operation portion is provided, wherein the actuator is engaged with an engaging portion of the driving cam so as to rotate the driving cam in either direction depending upon the entrance or retreat of the actuator, wherein the rotation of the driving cam in either direction causes an operating rod disposed in a switch portion of the switch body to reciprocate as sliding on a cam curve portion of the driving cam, thereby shifting a switching device of the switch portion between an off state and an on state based on which the entrance or retreat of the actuator is detected, wherein the switch body has a rectangular solid shape, a single actuator entrance hole is formed at one peripheral surface constituting one corner portion of the switch body, the peripheral surface included in the six outside surfaces of the switch body, and a cable lead-out port of a cable connected to the switching device of the switch portion is formed at the other corner portion opposite the one corner portion of the switch body.

According to such a constitution, a relation between the actuator entrance hole and the cable lead-out port provides a high degree of freedom with respect to the direction of leading out the cable, thus permitting the safety switch to be installed on the wall surface or the protective door. Furthermore, the actuator entrance hole may be oriented horizontally and vertically. In addition, the safety switch may be firmly attached to the installation place at each of the front side and back side thereof. Therefore, the safety switch is increased in the degree of mounting freedom, allowing for a wider choice of place to mount the safety switch. The switch body includes only one actuator entrance hole, obviating the actuator entrance hole left unused. Hence, the safety switch is prevented from suffering failure caused by the foreign substances invading through the unused actuator entrance hole. The switch body includes only one actuator entrance hole so that the driving cam may be so configured as to receive the actuator entering in one direction. Hence, the driving cam may be formed with one engaging portion and one cam curve portion in spaced relation, obviating the area having the poor strength due to the closely spaced relation between the engaging portion and the cam curve portion, which is encountered by the conventional driving cam. Thus, the driving cam is increased in strength, so that the safety switch is increased in durability. Further, the protrusion of the bent cable may be minimized because the cable lead-out port is formed at the opposite corner portion to the actuator entrance hole. This negates the need for providing such a large space to allow for the cable bending as provided in the conventional safety switch. Accordingly, the safety switch is subjected to less locational constraints.

The safety switch may also have a constitution wherein a slant surface is formed at the opposite corner portion of the switch body, as inclined to two peripheral surfaces constituting the opposite corner portion, the two peripheral surfaces included in the six outside surfaces of the switch body, and wherein the cable lead-out port is formed at the slant surface. Such a constitution permits the cable led out through the cable lead-out port to be bent at an angle of about 45° relative to the lead-out port, preventing the bent cable from protruding from the switch body. Thus is avoided the problem of the conventional safety switch that the cable interferes when the safety switch is installed on the wall surface or the like. Hence, the two peripheral surfaces adjoining the slant surface, formed with the lead-out port, may be firmly attached to the wall surface or the like for installation of the safety switch.

The safety switch may also have a constitution wherein any one of the five outside surfaces of the switch body except for the peripheral surface formed with the actuator entrance hole is used as a mounting surface to the fixing member. Such a constitution permits all the outside surfaces of the safety switch, except for the peripheral surface formed with the actuator entrance hole, to be firmly attached to the wall surface or the like for installation of the safety switch.

EFFECTS OF THE INVENTION

According to the first aspect of the invention, the relation between the actuator entrance hole and the cable lead-out port provides such a high degree of freedom with respect to the cable lead-out direction as to permit the safety switch to be installed on the wall surface or the protective door. Further, the actuator entrance hole may be oriented horizontally and vertically. In addition, the safety switch may be installed with either side (the front or back side) thereof firmly attached to the installation place. Thus, the safety switch is increased in the mounting freedom, so as to offer a wider choice of place to mount the safety switch. The switch body includes only one actuator entrance hole, obviating the actuator entrance hole left unused. Hence, the safety switch is prevented from suffering failure caused by the foreign substances invading through the unused actuator entrance hole. The switch body includes only one actuator entrance hole so that the driving cam may be so configured as to receive the actuator entering in one direction. Hence, the driving cam may be formed with one engaging portion and one cam curve portion in spaced relation. The driving cam itself may be increased in strength, as obviating the area having the poor strength. This results in the increased durability of the safety switch. Further, the protrusion of the bent cable may be minimized because the cable lead-out port is formed at the opposite corner portion to the actuator entrance hole. This negates the need for providing such a large space to allow for the cable bending as provided in the conventional safety switch. Accordingly, the safety switch is subjected to less locational constraints.

According to the second aspect of the invention, the cable led out through the cable lead-out port may be bent at the angle of about 45° relative to the lead-out port, preventing the bent cable from protruding from the switch body. The two peripheral surfaces adjoining the slant surface, formed with the lead-out port, may be firmly attached to the wall surface or the like for installation of the safety switch. Therefore, the safety switch is further increased in the mounting freedom, allowing for an even wider choice of place to mount the safety switch.

According to the third aspect of the invention, all the outside surfaces of the safety switch, except for the peripheral surface formed with the actuator entrance hole, may be firmly attached to the wall surface or the like for installation of the safety switch. Therefore, the safety switch is increased in the mounting freedom, allowing for the wider choice of place to mount the safety switch.

BRIEF DESCRIPTION OF THE DRAWINGS

FIGS. 6A to 6D are a sectional view of a lock switching device according to the first embodiment of the invention;

DETAILED DESCRIPTION OF THE INVENTION

First Embodiment

Figure 1:
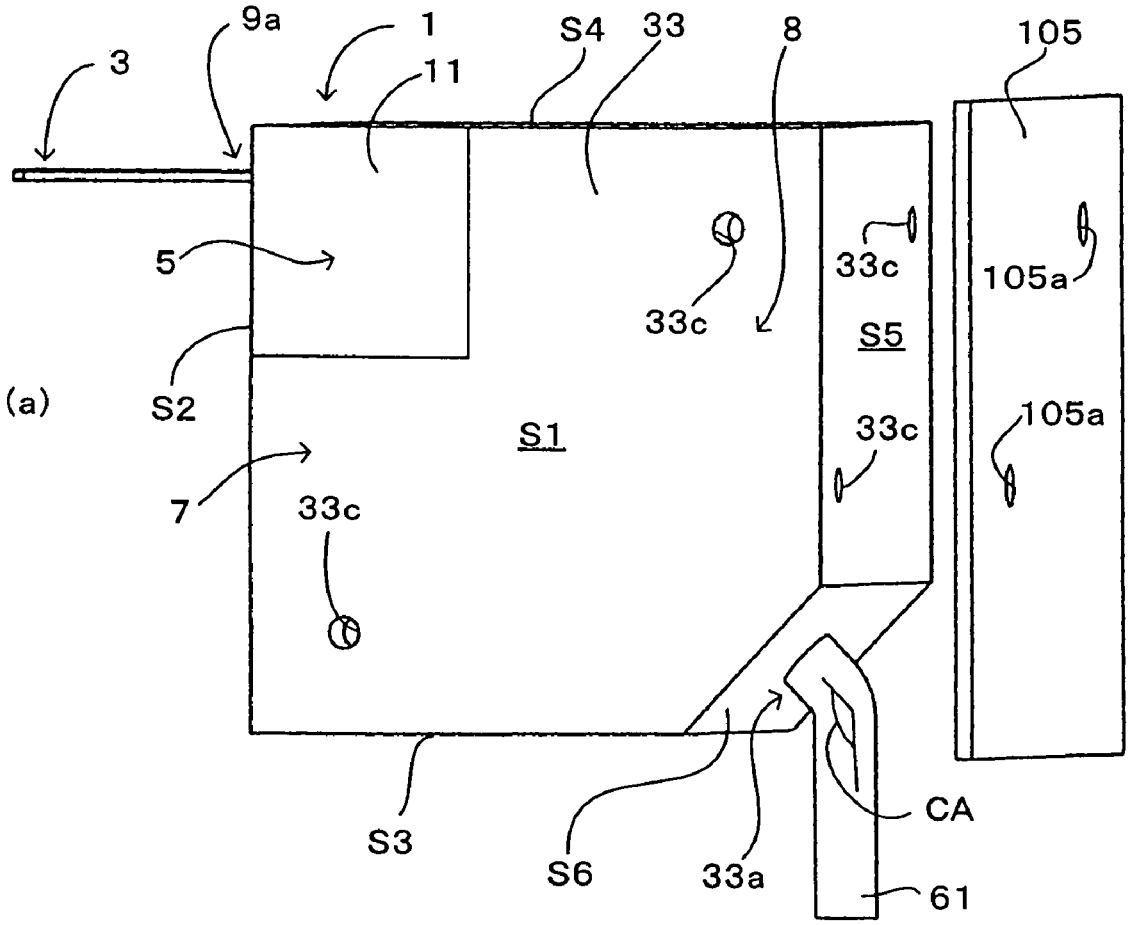
FIG. 1 is an external view of a safety switch according to a first embodiment of the invention.
Figure 7A:
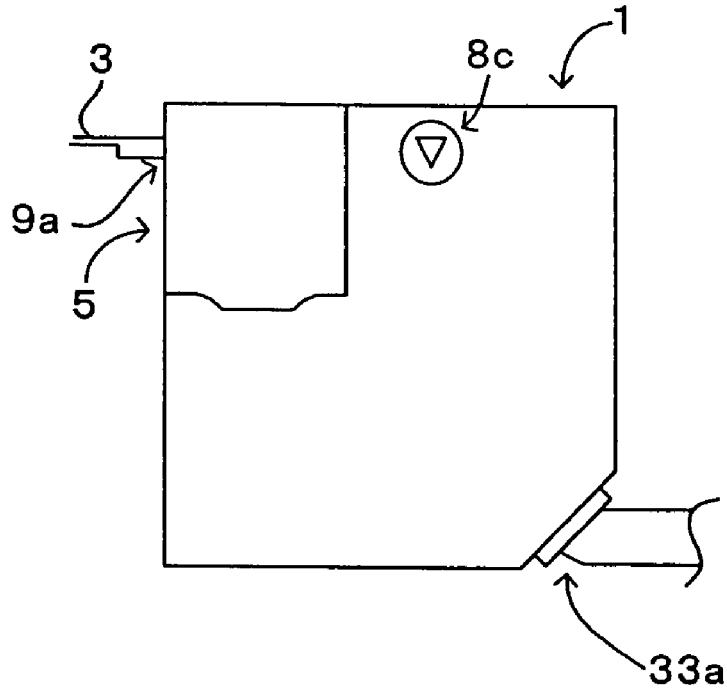
FIGS. 7A and 7B are an external view of the safety switch according to the first embodiment of the invention.
Figure 7B:
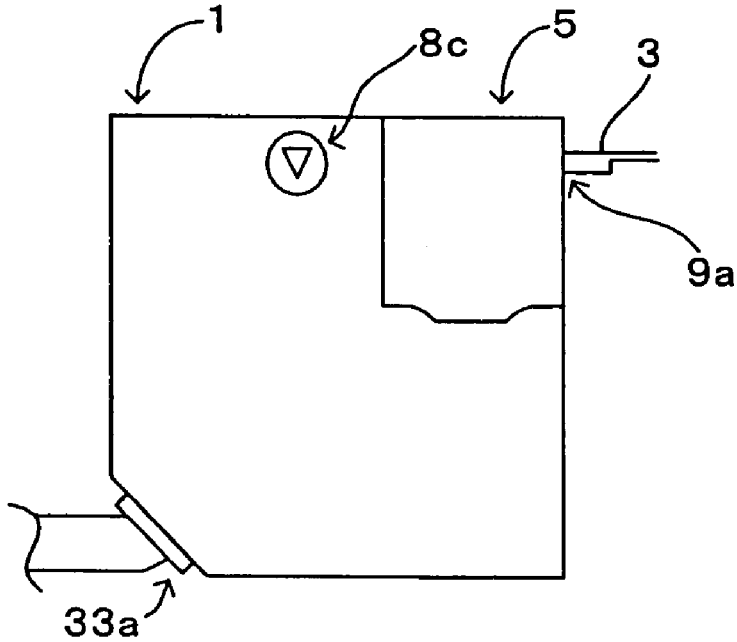
Figure 8:
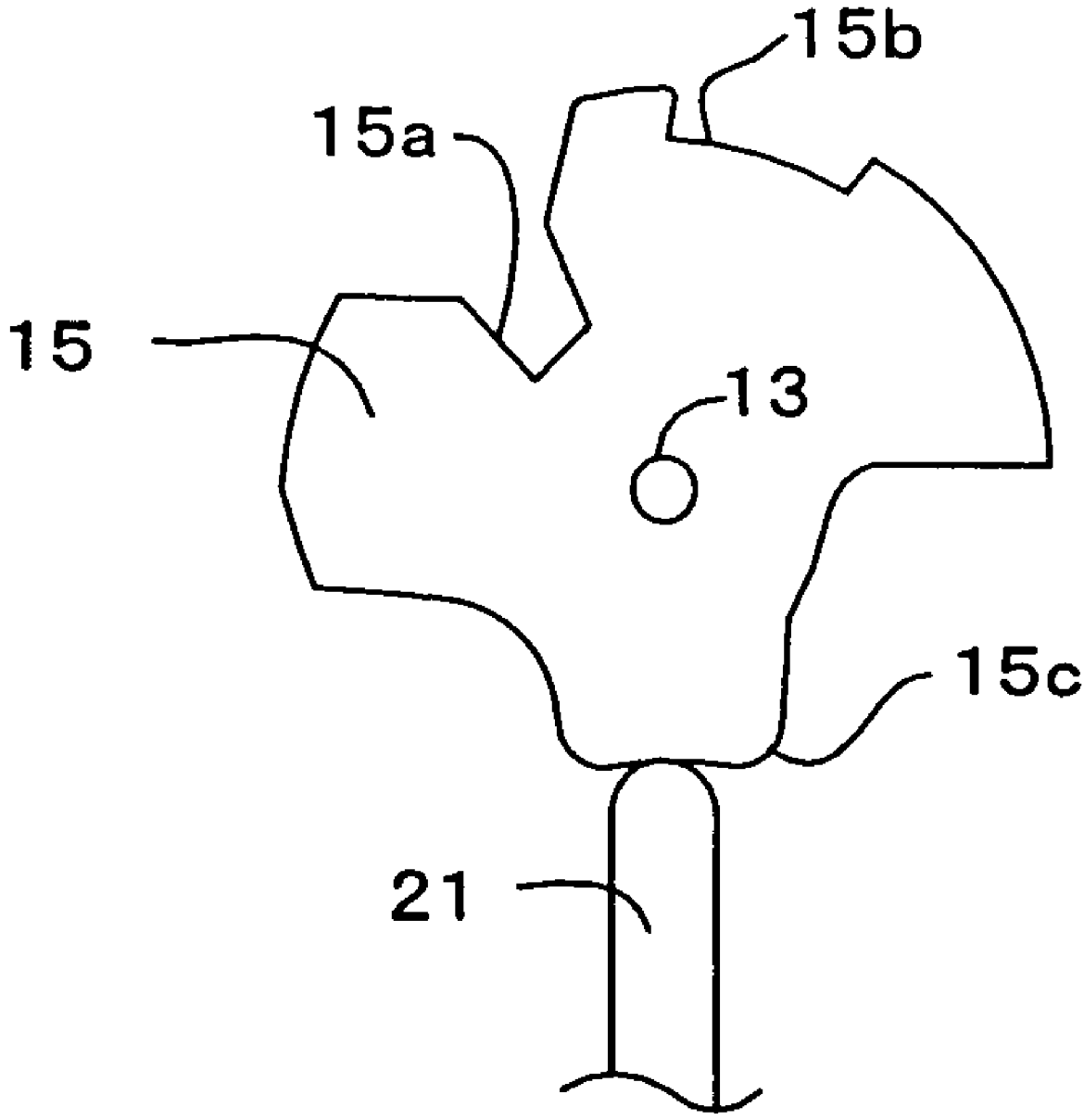
FIG. 8 is an enlarged view of a driving cam according to the first embodiment of the invention.
Figure 9:
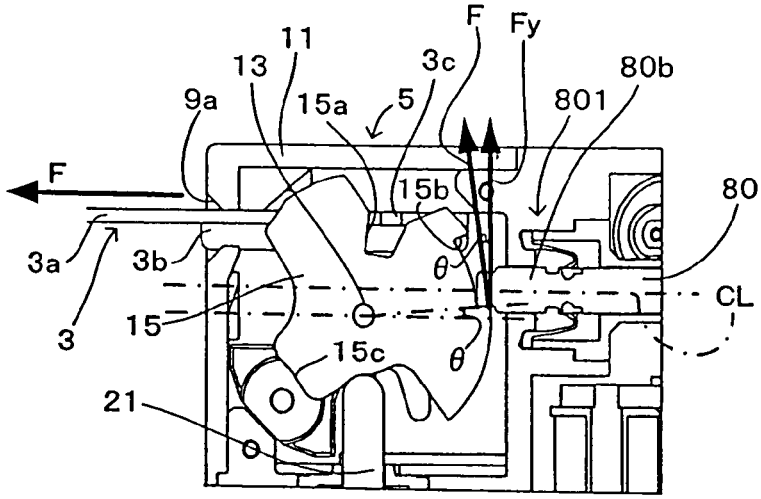
FIG. 9 is an enlarged view of an operation portion according to the first embodiment of the invention.

A first embodiment of the invention will be described with reference to FIG. 1 to FIG. 9. FIG. 1 is an external view of a safety switch. FIG. 2 to FIG. 5 are sectional views of a switch body. FIGS. 6A to 6D are a sectional view of a lock switching device. FIGS. 7A and 7B are an external view of the safety switch. FIG. 8 is an enlarged view of a driving cam. FIG. 9 is an enlarged view of an operation portion.

Similarly to the conventional safety switch as described above, a safety switch according to the invention is electrically connected with industrial machines such as a robot as an external apparatus by means of a cable. As shown in FIG. 1, the safety switch comprises a switch body 1 and an actuator 3. The switch body 1 has a constitution wherein removably attachable first case member 11 and second case member 33 are unified with each other to form a rectangular solid. At a corner portion (equivalent to "one corner portion" of the invention) defined by peripheral surfaces S2, S4, an actuator entrance hole 9*a* is formed at one S2 of the peripheral surfaces. At a corner portion (equivalent to "the other corner portion" of the invention) defined by two peripheral surfaces S3, S5 of the six outside surfaces of the switch body 1 and opposing the corner portion formed with the actuator entrance hole 9*a*, a slant surface S6 is formed which is inclined to the respective peripheral surfaces S3, S5. The slant surface S6 is formed with a cable lead-out port 33*a*. A cable 61 connected to a switching device to be described hereinlater is led out of the switch body 1 through the cable lead-out port 33*a* so as to be connected with the industrial machines such as the robot as the external apparatus.

As shown in FIG. 1, receiving holes 33*c* with internal threads are formed at any of an outside surface S1 and peripheral surfaces S3, S4, S5 except for the surfaces S2, S6 individually formed with the actuator entrance hole 9*a* and the cable lead-out port 33*a*. The receiving holes 33*c* are threadedly engaged with bolts for mounting the switch body 1 to a fixing member 105. The fixing member 105 is formed with receiving holes 105*a* at places corresponding to the receiving holes 33*c* formed at the switch body 1, such that the fixing member 105 may be combined with the switch body 1 by means of the bolts or the like. The safety switch 1 with the bent cable 61 has its outside surface S5 firmly attached to the fixing member 105 by means of the bolts or the like. In this case, the cable 61 may be bent at an angle CA of about 45°. An unillustrated outside surface on the back side of the outside surface S1 of the switch body 1 is also formed with the receiving holes 33*c*. Incidentally, the receiving holes 33*c*, 105*a* may be in the form of a recess rather than a through-hole.

Figure 2:
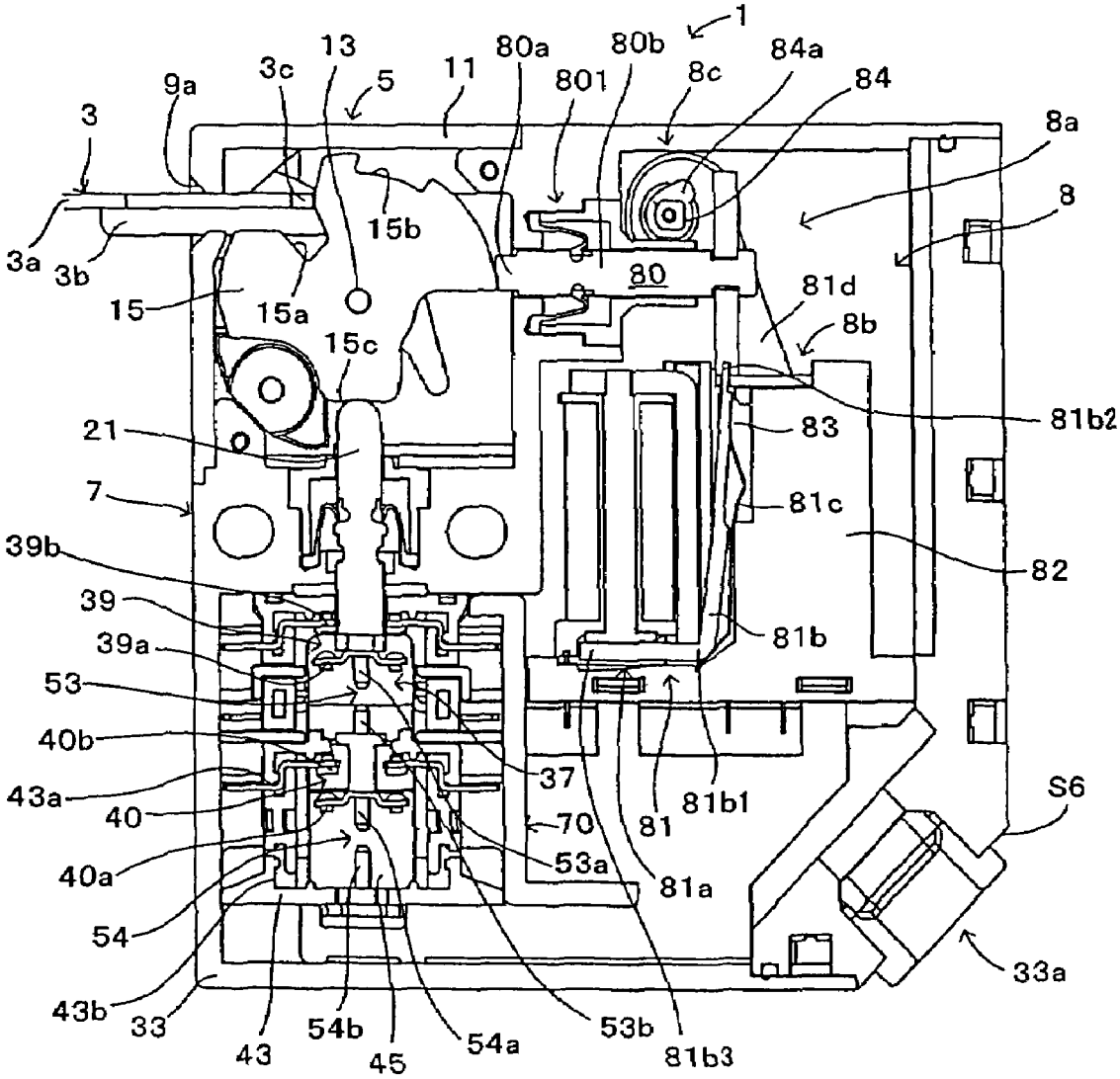
FIG. 2 is a sectional view of a switch body according to the first embodiment of the invention.

As shown in FIG. 2, the switch body 1 comprises an operation portion 5, a switch portion 7 and a lock mechanism portion 8. The switch body is secured to a wall surface around an unillustrated protective door to the industrial machines by way of the fixing member 105. The actuator 3 is secured to the protective door and is located at place opposite the actuator entrance hole 9*a* formed in the side surface (the outside surface S2) of the operation portion 5. When the protective door is closed, the actuator enters into the actuator entrance hole 9*a* of the operation portion 5. As shown in FIG. 2, the actuator 3 comprises: a base 3*a*; a pair of pressing pieces 3*b* projecting from the base 3*a*; and a connecting piece 3*c* interconnecting these pressing pieces 3*b*. In contrast to pressing pieces of an actuator which are shaped like a flat plate having a great width and a small thickness, these pressing pieces 3*b* have a shape having a small width and a great thickness, defining a U-shaped section through the connecting piece 3*c*.

As shown in FIG. 2 to FIG. 5, the operation portion 5 disposed at an upper left part of the switch body 1 includes a case member 11, and a driving cam 15 rotatably supported by a rotary shaft 13 pivotally mounted to an inside surface of the case member 11. An upper part of an outer periphery of the driving cam 15 is formed with an engaging portion 15*a* in which the connecting piece 3*c* of the actuator 3 is fittingly inserted. The engaging portion 15*a* is so located as to be exposed to outside through the aforesaid actuator entrance hole 9*a*. The upper part of the outer periphery of the driving cam 15 is further formed with a lock portion 15*b* engageable with a lock body 80 of the lock mechanism portion 8 to be described hereinlater. A cam curve portion 15*c* is formed at a lower part of the outer periphery of the driving cam 15. A semi-spherical tip of an operating rod 21 is retractably projected into the operation portion 5 from the switch portion 7 under the operation portion 5, so as to make sliding contact with the cam curve portion 15*c* of the driving cam 15. When the operating rod 21 reciprocates with movement in or out of operation portion 5 in conjunction with the rotation of the driving cam 15, the switching devices of a switching device portion 70 incorporated in the switch portion 7 are shifted between an on state and an off state.

Next, description is made on the switch portion 7. The switch portion 7 is disposed under the operation portion 5 as accommodated in the case member 33 which is unified with the case member 11 to form the switch body 1 shaped like a rectangular solid. The switch portion 7 comprises the switching device portion 70 incorporating therein the switching devices, and the aforementioned operating rod 21. As described above, the cable lead-out port 33*a* for the cable 61 for external connection is formed at the corner portion of the case member 33, which diagonally opposes the corner portion of the case member 11 at which the actuator entrance hole 9*a* is formed.

The switching device portion 70 comprises: a movable member 37 making contact with the other end of the operating rod 21 so as to move unitarily with the operating rod 21, and first and second normally-closed switching devices 39, 40 shifted between the on and off states as interlocked with the movable member 37. The first and second normally-closed switching devices 39, 40 comprise a movable contact 39*a*, 40*a* and a stationary contact 39*b*, 40*b*, respectively. The movable contacts 39*a*, 40*a* are fixed to the movable member 37, whereas the stationary contacts 39*b*, 40*b* are fixed to a frame member 43 disposed at the switching device portion 70. Of the normally-closed switching devices 39, 40, the normally-closed switching device 39, for example, is used for enabling or cutting off power supply to the industrial machines, and is connected in series with a normally-closed switching device 86 disposed at the lock mechanism portion 8 to be described hereinlater. The normally-closed switching device 40 is used for monitoring the on/off state of the switching device for power supply and shutdown.

The movable member 37 comprises a plate-like base plate 45, and a first mounting portion 53 and a second mounting portion 54 which upstand from the opposite ends of one side (front surface as seen in FIG. 2) of the base plate 45. The movable member 37 has one end abutted against the other end of the operating rod 21 and has a coil spring (not shown) mounted to the other end thereof so that the movable member 37 is biased by the coil spring toward the operation portion 5 or upwardly. The mounting portions 53, 54 are provided with a respective pair of projections 53*a*, 53*b*, 54*a*, 54*b* opposing each other with respect to a longitudinal direction of the movable member 37.

Figure 3:
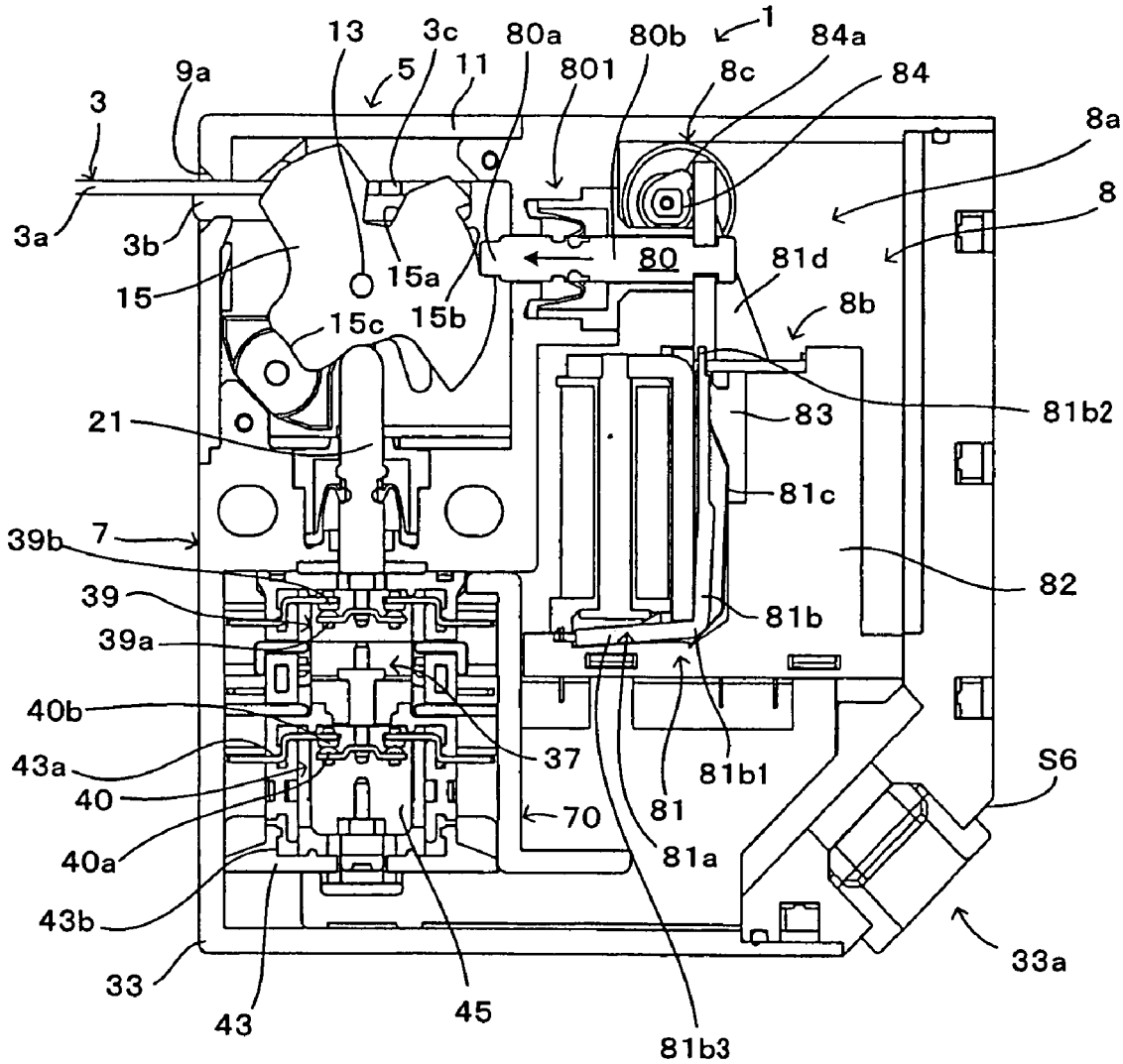
FIG. 3 is a sectional view of the switch body according to the first embodiment of the invention.
Figure 4:
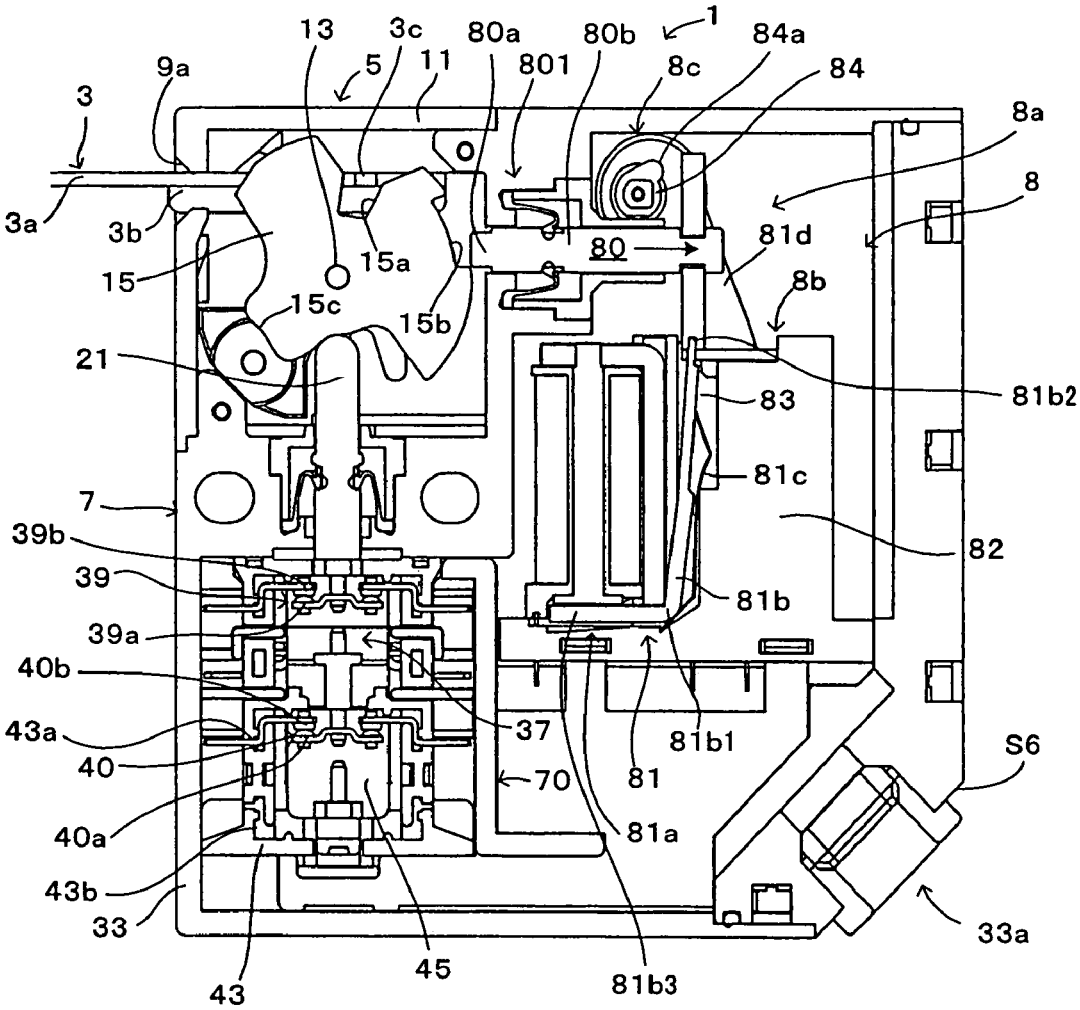
FIG. 4 is a sectional view of the switch body according to the first embodiment of the invention.

The movable contacts 39*a*, 40*a* of the first and second normally-closed switching devices 39, 40 are removably attached to respective root portions of the projections 53*a*, 54*a*. The movable contacts 39*a*, 40*a* are fixed to the respective mounting portions 53, 54 by means of springs (not shown) fitted about the respective pair of projections 53*a*, 53*b*, 54*a*, 54*b*, the springs generating contacting force for establishing contact between the movable contacts 39*a*, 40*a* and the stationary contacts 39*b*, 40*b*, as shown in FIG. 3 in particular.

The case member 33 is equipped with a cable (not shown) electrically connected with the industrial machines. In the switching device portion 70, the cable is electrically connected with the normally-closed switching devices 39, 40 so that the detection of the actuator moved into or out of the operation portion 5 and the power supply to or shutdown of the industrial machines are carried out based on an electrical signal generated in conjunction with the switching action of the individual normally-closed switching devices 39, 40.

As shown in FIG. 2, the stationary contact 40*b* of the second normally-closed switching device 40 is removably mounted to a mounting portion for normally-closed switching device 43*a* formed at the frame member 43 of the switching device portion 70. A constitution is made such that the stationary contact and the movable contact 40*a* may be changed in their mounting positions and statuses. That is, the second normally-closed switching device 40 is adapted to be changed to a normally-open switching device.

Specifically, the frame member 43 is formed with the aforesaid mounting portion for normally-closed switching device 43*a* as well as a mounting portion for normally-open switching device 43*b* to which the stationary contact 40*b* is removably attached. The movable contact 40*a* of the second normally-closed switching device 40 may be removed from the projection 54*a* on one side so as to be attached to the projection 54*b* on the other side, whereas the stationary contact 40*b* may be removed from the mounting portion for normally-closed switching device 43*a* so as to be attached to the mounting portion for normally-open switching device 43*b*, whereby the second normally-closed switching device 40 may be changed to the normally-open switching device. This makes the normally-open switching device perform the opposite switching action to that of the first normally-closed switching device 39. Hence, the normally-open switching device may be used for monitoring a different operation from that monitored by the second normally-closed switching device 40. Thus is provided a choice between the normally-closed mode and the normally-open mode according to use.

In the state of FIG. 2 where the actuator 3 is not moved in, the operating rod 21 is pressed by the cam curve portion 15*c* of the driving cam 15 against the coil spring so that the most part thereof is retracted in the switch portion 7. Hence, the movable member 37 is depressed by the operating rod 21, so that the movable contacts 39*a*, 40*a* and the stationary contacts 39*b*, 40*b* of the respective normally-closed switching devices 39, 40 are spaced away from each other. The individual normally-closed switching devices 39, 40 are in the off state to cut off the power supply to the industrial machines, which are disabled.

Next, description is made on the lock mechanism portion 8. As shown in FIG. 2, the lock mechanism portion 8 is disposed in the case member 33 at place rightward of the operation portion 5. The lock mechanism portion 8 comprises a lock mechanism 8*a* and a manual unlock mechanism 8*c*. The lock mechanism 8*a* comprises the aforementioned lock body 80, a driver 81 for moving the lock body 80, normally-open and normally-closed switching devices 85, 86, and a link body 81*d* operative in conjunction with the movement of the lock body 80 for shifting the normally-open and normally-closed switching devices 85, 86 between the on and off states. The normally-open and normally-closed switching devices 85, 86 are juxtaposed to each other as located at places forwardly and rearwardly, or a front side and rear side, of a lock switching device portion 8*b* as viewed in a direction perpendicular to the drawing surface.

The lock body 80 constituting the lock mechanism 8 is supported by a lock-body supporting portion 801 in a manner to be movable substantially perpendicularly to the rotary shaft 13 of the driving cam 15 between an unlock position shown in FIG. 2 and a lock position shown in FIG. 3. The lock body 80 is configured such that an outside diameter of a distal end 80*a* thereof is smaller than that of a proximal end 80*b* thereof. When the lock body 80 is moved to the lock position, the distal end 80*a* engages with the lock portion 15*b* of the driving cam 15 thereby locking the rotation of the driving cam 15. On the other hand, when the lock body 80 is moved to the unlock position, the distal end 80*a* is disengaged from the lock portion 15*b* so as to permit the rotation of the driving cam 15.

The driver 81 comprises: a hinge-shaped electromagnet 81*a* comprising a core with a coil wound thereabout and energized to generate an electromagnetic attractive force for displacing an action body 81*b* formed from a magnetic material such as iron and substantially in an L-shape, a bias spring 81*c* comprising a leaf spring for biasing the action body 81*b* leftward, and the link body 81*d* for transferring the displacement of the action body 81*c* to the lock body 80. The hinge-shaped electromagnet 81*a* is disposed in a manner to direct its center axis substantially orthogonal to the moving direction of the lock body 80. The hinge-shaped electromagnet 81*a* is supported by a case 82 of the lock switching device portion 8*b*. As shown in FIG. 2, the hinge-shaped electromagnet 81*a* is supported by the case 82 in a manner that a gap 83 is defined between the hinge-shaped electromagnet 81*a* and the case 82. The action body 81*b* and the bias spring 81*c* are disposed in the gap 83.

The action body 81*b* is a substantially L-shaped member which is configured to have a bent portion 81*b*1 bent at an obtuse angle and which includes one side defining a lower left end portion 81*b*3 and the other side defining an upper end portion 81*b*2 with respect to the bent portion. The action body 81*b* is disposed in the gap 83 in a manner to be pivotally movable about the bent portion 81*b*1. The bias spring 81*c* is disposed in the gap 83 at place rightward of the action body 81*b* in a manner that a lower end of the bias spring along with the bent portion 81*b*1 of the action body 81*b* are retained in a fixed state and that an upper end of the spring is abutted against the upper end portion 81*b*2 of the action body for biasing the upper end portion 81*b*2 leftward. The upper end portion 81*b*2 of the action body 81*b* is coupled (engaged) with the link body 81*d*, by which the lock body 80 is axially supported.

As shown in FIG. 3, when the hinge-shaped electromagnet 81*a* is de-energized, the action body 81*b* is biased leftward by the bias spring 81*c* so that the upper end portion 81*b*2 is moved leftward as pivoted about the bent portion 81*b*1. In conjunction with the leftward movement of the upper end portion 81*b*2, the link body 81*d* coupled with the upper end portion 81*b*2 is moved leftward so that the lock body 80 axially supported by the link body 81*d* is moved in a direction of an arrow in FIG. 3 or to the lock position. On the other hand, when the hinge-shaped electromagnet 81*a* is energized, the lower left end portion 81*b*3 (first side) of the action body 81*b* is attracted upward or to the hinge-shaped electromagnet 81*a* by way of the electromagnetic attractive force of the hinge-shaped electromagnet 81*a*. Consequently, the upper end portion 81*b* (second side) of the action body 81*b* is pivotally moved about the bent portion 81*b*1 against the leftward biasing force of the bias spring 81*c*, so as to be moved in a rightward direction substantially orthogonal to the direction in which the lower left end portion 81*b*3 is attracted to the hinge-shaped electromagnet 81*a*. In conjunction with the rightward movement of the upper end portion 81*b*2, the link body 81*d* coupled with the upper end portion 81*b*2 is moved rightward so that the lock body 80 axially supported by the link body 81*d* is moved in a direction of an arrow in FIG. 4 or to the unlock position.

As shown in FIG. 6, the normally-open switching device 85 and the normally-closed switching device 86 are juxtaposed to each other in the case 82 of the lock switching device portion 8*b* (lock mechanism). The normally-open switching device 85 is disposed on the front side whereas the normally-closed switching device 86 is disposed on the rear side. These normally-open switching device 85 and normally-closed switching device 86 include respective movable contacts 85*a*, 86*a* and respective stationary contacts 85*b*, 86*b*. The switching devices have their terminal plates with these contacts supported by the case 82 at lower ends thereof, whereby the switching devices are mounted in the case 82 (see FIG. 6). The normally-open switching device 85 has the movable contact 85*a* located on the left side from the stationary contact 85*b*, whereas the normally-closed switching device 86 has the movable contact 86*a* located on the right side from the stationary contact 86*b*. Respective upper ends 85*a*1, 86*a*1 of the terminal plates equipped with the movable contacts 85*a*, 86*a* are engaged with the link body 81*d*. Therefore, these movable contacts 85*a*, 86*a* are simultaneously moved in the same direction as interlocked with the movement of the link body 81*d*. According to the embodiment, the link body 81*d* provides linkage between the lock body 80 and the movable contacts 85*a*, 86*a*. Therefore, when the link body 81*d* is moved in a direction of an arrow LK so as to move the lock body 80 to the lock position (see FIG. 3), the normally-open and normally-closed switching devices 85, 86 are simultaneously shifted to the off and on states, respectively (see FIG. 6B and FIG. 6D). When the link body 81*d* is moved in a direction of an arrow UL so as to move the lock body 80 to the unlock position (see FIG. 2, FIG. 4), the normally-open and normally-closed switching devices 85, 86 are simultaneously shifted to the on and off states, respectively.

According to the embodiment, the link body 81*d* engaged with the upper end portion 81*b*2 of the action body 81*b* provides the linkage between the lock body 80 and the movable contacts 85*a*, 86*a*. Hence, the displacement of the upper end portion 81*b*2 of the action body 81*b* caused by the electromagnetic attractive force of the hinge-shaped electromagnet 81*a* is simultaneously transferred to the lock body 80 and the movable contacts 85*a*, 86*a* by means of the link body 81*d* so that the lock body 80 and the movable contacts 85*a*, 86*a* are moved at the same time. As described above, the normally-closed switching device 86 in the case 82, for example, is connected in series with the first normally-closed switching device 39 of the switching devices disposed in the switching device portion 70, the first normally-closed switching device 39 connected with the industrial machines. The operation of the lock body 80 may be detected by monitoring the electrical signal from the normally-open switching device 85.

The manual unlock mechanism 8*c* comprises a release cam 84 including a projection 84*a*. When the lock body 80 is moved to the lock position so as to be engaged with the lock portion 15*b* as shown in FIG. 3, the lock state may be cancelled by rotating the release cam 84 clockwise by means of a release key or the like inserted from outside the switch body 1. Specifically, the clockwise rotation of the release cam 84 causes the projection 84*a* to slide on the link body 81*d* so as to move the link body 81*d* rightward. Consequently, the lock body 80 axially supported by the link body 81*d* is also moved rightward in conjunction with the rightward movement of the link body 81*d*, so that the lock body 80 is disengaged from the lock portion 15*b*, permitting the driving cam 15 to rotate.

Next, the operations are described. In a case where the actuator 3 is not advanced into the operation portion 5 of the switch body 1, as shown in FIG. 2, the most part of the operating rod 21 is retracted in the switch portion 7 as depressed against the coil spring by the greater diameter portion of the cam curve portion 15*c* of the driving cam 15. Hence, the movable member 37 is depressed by the operating rod 21. Thus, the movable contacts 39*a*, 40*a* and the stationary contacts 39*b*, 490*b* of the normally-closed switching devices 39, 40 are spaced from each other. Namely, the normally-closed switching devices 39, 40 are in the off state to cut off the power supply to the industrial machines which are disabled. On the other hand, the lock body 80 is moved to the unlock position as pressed against the bias spring 81*c* by the outer periphery of the driving cam 15. As shown in FIG. 6A and FIG. 6C, the normally-open and normally-closed switching devices 85, 86 of the lock switching device portion 8*b* are in the on state and the off state, respectively.

Subsequently when the actuator 3 is advanced into the operation portion 5 by closing the protective door, the connecting piece 3*c* of the actuator 3 engages with the engaging portion 15*a* of the driving cam 15, as shown in FIG. 3, so that the driving cam 15 is rotated clockwise as the actuator 3 is further advanced. In conjunction with the rotation of the driving cam 15, the tip of the operating rod 21 slides on the cam curve portion 15*c* from the greater diameter portion to the smaller diameter portion while the operating rod 21 is moved upward by the biasing force of the coil spring. In conjunction with the upward movement of the operating rod 21, the normally-closed switching devices 39, 40 are shifted from the off state to the on state. In conjunction with the rotation of the driving cam 15, the lock portion 15*b* is moved to a position opposite the lock body 80 so as to permit the lock body 80 to be moved leftward by the biasing force of the bias spring 81*c*. Hence, the lock portion 15*c* is engaged with the distal end 80*a* of the lock body 80, whereby the rotation of the driving cam 15 is locked to inhibit the extraction of the actuator 3. Further, the movement of the lock body 80 to the lock position shifts the normally-open and normally-closed switching devices 85, 86 of the lock switching device portion 8*b* to the off state and the on state, respectively, as shown in FIG. 6B and FIG. 6D. Since the normally-closed switching device 86 of the lock switching device portion 8*b* and the first normally-closed switching device 39 are simultaneously shifted to the on state, the industrial machines, such as robots, connected in series with these normally-closed switching devices are supplied with the electric power and are enabled to operate.

In a case where the hinge-shaped electromagnet 81*a* is energized by external control, the lower left end portion 81*b*3 of the action body 81*b* is attracted to the hinge-shaped electromagnet 81*a* by means of the electromagnetic attractive force of the hinge-shaped electromagnet 81*a*. Accordingly, the upper end portion 81*b*2 of the action body 81*b* is pivotally moved about the bent portion 81*b*1 against the biasing force of the bias spring 81*c*, so as to be moved in the rightward direction substantially orthogonal to the direction in which the lower left end portion 81*b*3 of the action body 81*b* is attracted by the hinge-shaped electromagnet 81*a*. Hence, the lock body 80 is moved rightward to the unlock position in conjunction with the rightward movement of the link body 81*d*. Thus, the lock body 80 is disengaged from the lock portion 15*b*, so that the driving cam 15 is released from the lock against rotation. The actuator 3 is permitted to retreat thereby permitting the protective door or the like to be opened. As the lock body 80 is moved to the unlock position, the normally-open and normally-closed switching devices 85, 86 of the lock switching device portion 8*b* are shifted to the on state and the off state, respectively, as shown in FIG. 6A and FIG. 6C. Consequently, the power supply to the industrial machines connected in series with the normally-closed switching device 86 of the lock switching device portion 8*b* and the normally-closed switching device 39 is cut off, whereby the industrial machines are disabled to operate. In the meantime, the unlock state is detected by way of the electrical signal through the normally-open switching device 85 of the lock switching device portion 8*b*.

Figure 5:
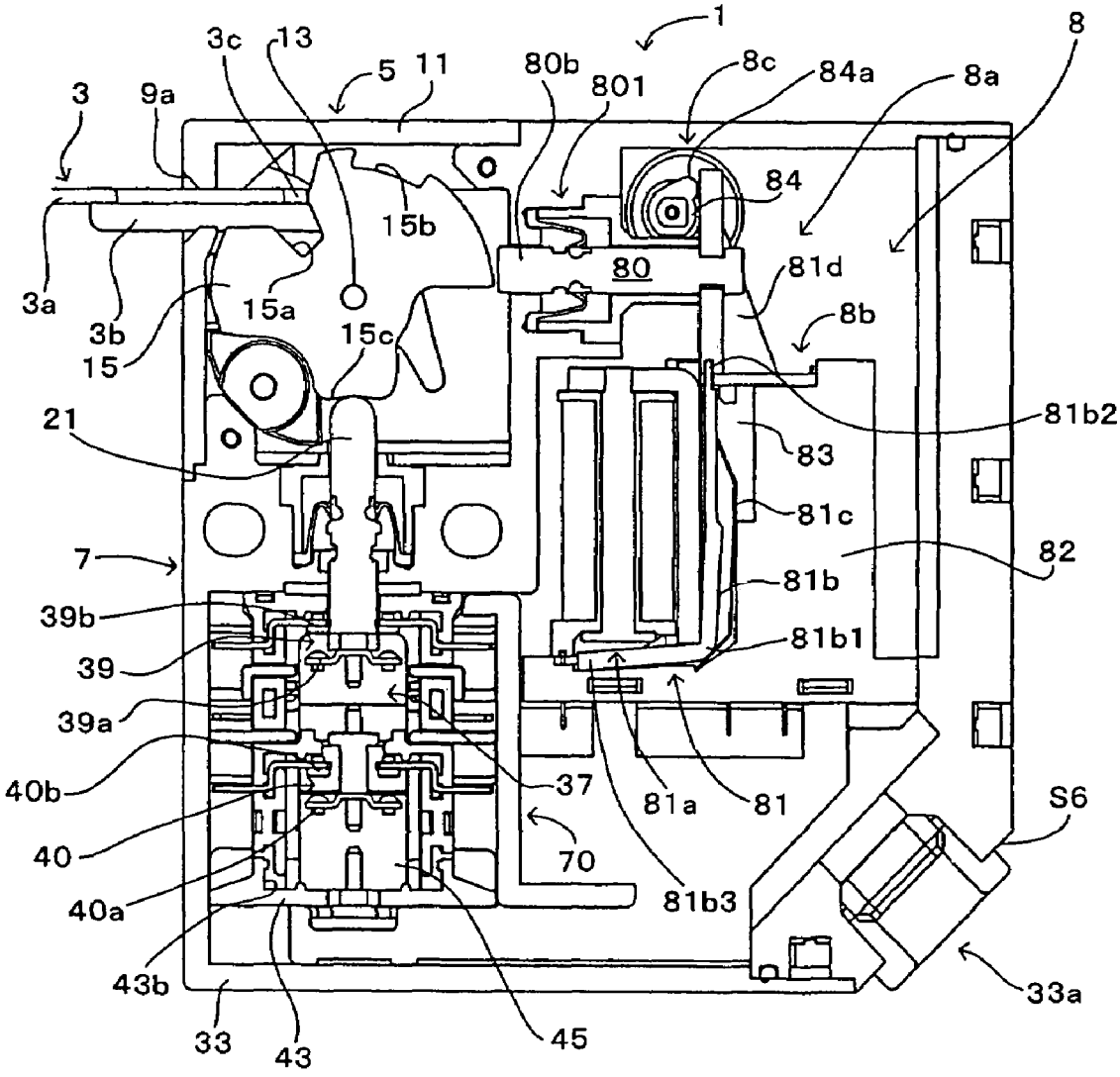
FIG. 5 is a sectional view of the switch body according to the first embodiment of the invention.

Now referring to FIG. 3 and FIG. 5, a detailed description is made on a case where the actuator 3 is to be forcibly extracted from the operation portion 5 in a sate where the driving cam 15 is locked against rotation as shown in FIG. 3. When the actuator 3 is forcibly retreated, a forcible rotating force is applied to the driving cam 15 because the connecting piece 3*c* of the actuator 3 is engaged with the engaging portion 15*a* of the driving cam 15. At this time, the distal end 80*a* of the lock body 80 stays engaged with the lock portion 15*b* of the driving cam 15 and hence, the force of extracting the actuator 3 is concentrated on the engagement area between the distal end 80*a* locking the driving cam 15 and the lock portion 15*b*. The distal end 80*a* is designed to have the smaller diameter so as to have a lower breaking strength than the lock portion 15*b*. Therefore, if the actuator 3 is forcibly extracted from the switch body 1, the distal end 80*a* of the lock body, which has the lower breaking strength, is broken before the lock portion 15*b* of the driving cam 15 is broken. Thus, the driving cam 15 is brought into a rotatable state.

As the actuator 3 is retreated from the operation portion 5, the driving cam 15 is rotated counterclockwise so that the connecting piece 3*c* of the actuator 3 is disengaged from the engaging portion 15*a*. At this time, as shown in FIG. 5, the cam curve portion 15*c* of the driving cam 15 and the operating rod 21 are intact or in a normal condition. In conjunction with the counterclockwise rotation of the driving cam 15, therefore, the operating rod 21 is moved downward against the biasing force of the coil spring as sliding on the cam curve portion 15*c* from the smaller diameter portion to the greater diameter portion. As the operating rod 21 is moved downward, the normally-closed switching devices 39, 40 of the switching device portion 70 are shifted to the off state in a normal manner. Since the normally-closed switching devices 39, 40 of the switching device portion 70 operate normally, the extraction (retreat) of the actuator 3 may be detected based on the state of these normally-closed switching devices 39, 40. It is thus ensured that the power supply to the industrial machines is positively cut off.

By the way, the switch body 1 has a rectangular solid shape and is constituted such that the actuator entrance hole 9*a* is formed at one of the pair of opposite corner portions thereof whereas the cable lead-out port 33*a* is formed at the other corner portion. As shown in FIGS. 7A and 7B, therefore, the positional relation between the actuator entrance hole 9*a* and the cable lead-out port 33*a* provides a high degree of freedom with respect to the direction of leading out the cable 61, thus permitting the switch body 1 to be installed at any of the places including the wall surface, the fixing member 105 and the protective door. Furthermore, the actuator entrance hole 9*a* may be oriented horizontally or vertically. In addition, the switch body 1 may be firmly attached to the installation place at either side (front side and back side) thereof. FIG. 7A is a view of the safety switch as seen from the front side, whereas FIG. 7B is a view of the safety switch as seen from the back side.

Accordingly, the embodiment achieves a higher degree of freedom of mounting the safety switch, allowing for a wider choice of place to mount the safety switch. The switch body 1 includes only one actuator entrance hole 9*a*, obviating the actuator entrance hole left unused. Hence, the safety switch is prevented from suffering failure caused by the foreign substances invading through the unused actuator entrance hole. The safety switch may be enhanced in durability.

In this embodiment, the switch body 1 is formed with only one actuator entrance hole 9*a*. Therefore, as shown in FIG. 8, the driving cam 15 may be configured such that one engaging portion 15*a* and one cam curve portion 15*c* are formed in spaced relation. The driving cam 15 is adapted to obviate the area having the poor strength, achieving a higher strength than the conventional driving cam. Hence, the driving cam 15 per se may be prevented from being broken if, for example, the actuator 3 engaged with the engaging portion 15*a* is to be forcibly extracted. Accordingly, the safety switch may be enhanced in durability.

According to the embodiment, the cable 61 led out through the cable lead-out port 33*a* may be bent at place near the lead-out port 33*a* at an angle of about 45°. Therefore, the bent cable 61 is prevented from protruding from the switch body 1. The switch body 1 may be installed in a manner that the two peripheral surfaces S3, S5 adjoining the slant surface S6 formed with the lead-out port 33*a* are firmly attached to the wall surface, the fixing member 105 or the like. Since the cable 61 led out from the switch body 1 does not interfere when the switch body 1 is installed at any of various places, the switch body 1 may be disposed as desired. For instance, the switch body 1 may be firmly attached to the wall surface or the like, or installed at an upper end or a lower end of the wall surface or the like. The embodiment achieves an even higher degree of freedom of mounting the safety switch, allowing for an even wider choice of place to mount the safety switch.

Further, the embodiment is adapted to permit all the outside surfaces of the switch body 1 except for the surfaces S2, S6 formed with the actuator entrance hole 9*a* and the cable lead-out port 33*a* to be firmly attached to the fixing member 105 for installing the switch body 1 to the wall surface or the like. Thus, the embodiment further increases the degree of freedom of mounting the safety switch, allowing for the wider choice of place to mount the safety switch.

As described above, the conventional safety switch has the problem that the cable led out from the safety switch interferes in the installation of the safety switch. Hence, the safety switch is provided with the two cable lead-out ports in order to cope with some case where an installation mode of the safety switch dictates the need to change the cable lead-out port to be used. According to the embodiment, however, the cable lead-out port 33*a* is formed at the corner portion opposite the actuator entrance hole 9*a* so that the bent portion of the cable 61 is less protruded. Hence, the embodiment negates the need to provide such a large space to allow for the cable bending as provided in the conventional safety switch. That is, the switch body 1 formed with only one cable lead-out port 33*a* is adapted for various modes of fixing the safety switch to the fixing member 105 or the like. This leads to a simplified wiring process and the like in the installation of the safety switch. Hence, the safety switch may be installed easily.

According to the embodiment, the switch body 1 is formed with the slant surface S6, where the cable lead-out port 33*a* is formed. Alternatively, a recess may be formed in place of the slant surface S6. Another constitution may be made wherein the cable lead-out port is directly formed at the corner portion defined by the peripheral surfaces S3, S5.

The embodiment ensures that the cam curve portion 15*c* of the driving cam 15 and the operating rod 21 stay in undamaged, normal conditions even in a case where the driving cam 15 is brought into the rotatable state because the lock body having the lower breaking strength is broken by forcibly extracting the actuator 3 from the operation portion 5 in the state where the driving cam 15 is locked against rotation. Therefore, when the retreat of the actuator 3 from the operation portion 5 causes the driving cam 15 to rotate counterclockwise so that the connecting piece 3*c* of the actuator 3 is disengaged from the engaging portion 15*a*, the operating rod 21 is moved downward as sliding on the cam curve portion 15*c* from the smaller diameter portion to the greater diameter portion. In conjunction with the downward movement of the operating rod 21, the normally-closed switching devices 39, 40 of the switching device portion 70 are shifted to the off state in the normal manner, so that the extraction (retreat) of the actuator 3 may be detected based on the status of the normally-closed switching devices. Hence, the retreat of the actuator 3 from the switch body 1 may be assuredly detected even in a case where the protective door or the like are forcibly opened without taking a normal unlocking step and the actuator 3 is extracted from the switch body 1.

As shown in FIG. 9, the embodiment has a constitution wherein the rotary shaft 13 of the driving cam 15 as the center of rotation of the driving cam 15 is in an offset positional relation (skew) with a moving direction CL of the distal end 80*a* of the lock body 80, which is engageable with the lock portion 15*b* of the driving cam 15 and movable between the lock position and the unlock position. Therefore, a force F forcibly extracting the actuator 3 may be decomposed into a force acting in the moving direction of the distal end 80*a* of the lock body 80 and a force Fy acting in a direction substantially orthogonal to the moving direction CL. That is, the force acting to break the distal end 80*a* of the lock body 80 or the force Fy acting in the direction substantially orthogonal to the moving direction CL may be made smaller than the above extracting force F (F>Fy). In consequence, it is possible to use a member having a lower strength as the lock body 80 or to downsize the lock body 80. Hence, a highly versatile member may be used as the lock body 80 for reducing the cost of the safety switch. Further, the safety switch may be reduced in size. Since it is possible to use a member of a smaller weight as the lock body 80, the lock body 80 can be moved by a smaller force than that required for moving the conventional lock body 80. This permits the use of a more compact hinge-shaped electromagnet 81*a* so that the safety switch may be even further downsized. FIG. 9 is an enlarged view of the operation portion.

According to the embodiment, the breaking strength of the distal end 80*a* of the lock body 80 is defined to be smaller than that of the lock portion 15*b* of the driving cam 15. Hence, the distal end 80*a* of the lock body 80 is more prone to breakage than the lock portion 15*b* of the driving cam 15. In the event of breakage of the distal end 80*a* of the lock body 80, the safety switch may be made normally operative again by merely replacing the broken lock body 80. Thus, the cost reduction may be achieved.

According to the embodiment, the actuator 3 moving into or out of the operation portion 5 is detected by way of the electrical signal associated with the switching action of the normally-closed switching devices 39, 40 disposed in the switching device portion 70. Hence, the electrical signal associated with the switching action of the normally-closed switching devices 39, 40 may be used for externally detecting the entrance or retreat of the actuator 3.

The embodiment employs the two normally-closed switching devices 39, 40, the switching action of which effects the power supply to the industrial machines or the shutdown of the industrial machines. For instance, if the movable contacts 39*a*, 40*a* and the stationary contacts 39*b*, 40*b* of the normally-closed switching devices 39, 40 should be fused to each other during the power supply to the industrial machines permitted by the normally-closed switching devices 39, 40 in the on state, the actuator 3 may be moved back to cause the operating rod 21 to depress the movable member 37 whereby the movable contacts 39*a*, 40*a* and the stationary contacts 39*b*, 40*b* fused to each other may be forcibly separated from each other. Thus, the safety switch may be enhanced in reliability.

While the embodiment has the constitution wherein the receiving holes 33*c* used for fixing the switch body 1 to the fixing member 105 are formed in the switch body 1, the fixing method is not limited to the method using the bolts inserted through the receiving holes 33*c*. What is important is to make a constitution ensuring the reliable fixing of the safety switch to the fixing member 105.

According to the embodiment, the receiving holes 33*c* are formed at all the outside surfaces except for the outside surfaces S2, S6. It is of course unnecessary to form the receiving holes 33*c* at all the outside surfaces. A constitution may also be made such that the receiving holes 33*c* are formed only at some outside surfaces required for fixing the switch body 1 to the fixing member 105.

According to the embodiment, the outside surface S5 of the switch body 1 is firmly attached to the fixing member 105 for fixing the switch body 1. However, any of the outside surfaces may of course be firmly attached to the fixing member 105 because the receiving holes 33*c* are formed at all the outside surfaces except for the outside surfaces S2, S6.

According to the embodiment, the slant surface S6 of the switch body 1 is formed with the cable lead-out port 33*a*, through which the cable 61 is led into the switch body 1 for direct connection with connecting terminals of the switching devices therein. Alternatively, a connector connected with the connecting terminals of the switching devices in the switch body 1 may be provided in place of the cable lead-out port 33*a*. Such a constitution permits the connection between the external apparatus and the safety switch to be accomplished simply by inserting the cable in the connector. Thus is facilitated the connection between the safety switch and the external apparatus.

Another constitution may also be made such that a terminal block connected with the connecting terminals of the switching devices is provided in the switch body 1 and that the cable is led into the switch body 1 to be connected with the terminal block or the like. Such a constitution permits the use of various types of cables. Further, the constitution negates the need for replacing the safety switch together with the cable in the case of breakage of the safety switch. That is, only the safety switch may be replaced while the cable may remain installed.

Second Embodiment

Figure 10:
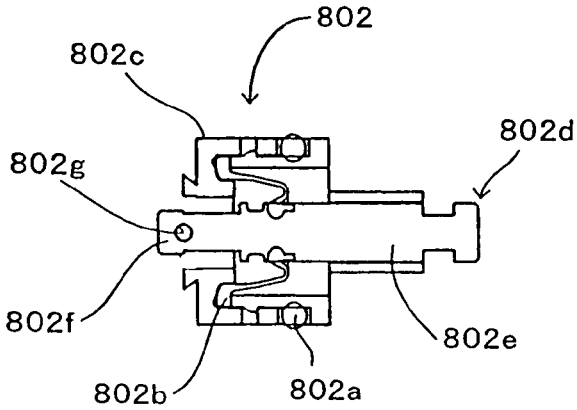
FIG. 10 is a diagram showing a lock body unit according to a second embodiment of the invention.

As a second embodiment of the invention, a lock body unit 802 may be constituted such that a lock body 802*d* is supported by a lock-body supporting portion 802*c* and seal members 802*a*, 802*b*, as shown in FIG. 10. In this case, the lock body unit 802 may be disposed at place upwardly of the hinge-shaped electromagnet 81*a* constituting the driver in a manner that the lock body unit is removably assembled in the driver. The lock body 802*d* comprises a base 802*e* and a distal end 802*f* continuous to the base 802*e*. A hole 802*g* for reducing the breaking strength may be formed by drilling a boundary portion between the base 802*e* and the distal end 802*f*.

The following advantage may be provided by unitizing the lock body 802*d* as the lock body unit 802 and removably assembling the unit in the driver. If the lock body 802*d* should be broken, the safety switch may be quickly and efficiently restored by replacing the lock body unit 802. The lock body 802*d* is formed with the hole 802*g* for reducing the breaking strength at the distal end 802*f* thereof. Therefore, when the actuator 3 is forcibly extracted from the main body of the safety switch, the distal end 802*f* of the lock body 802*d* is assuredly broken in first so that the lock portion of the driving cam may be maintained in the normal state. In the event of a failure of the safety switch caused by forcibly extracting the actuator from the main body of the safety switch, the safety switch may be restored to the normal condition by merely replacing the lock body unit 802.

Third Embodiment

Figure 11:
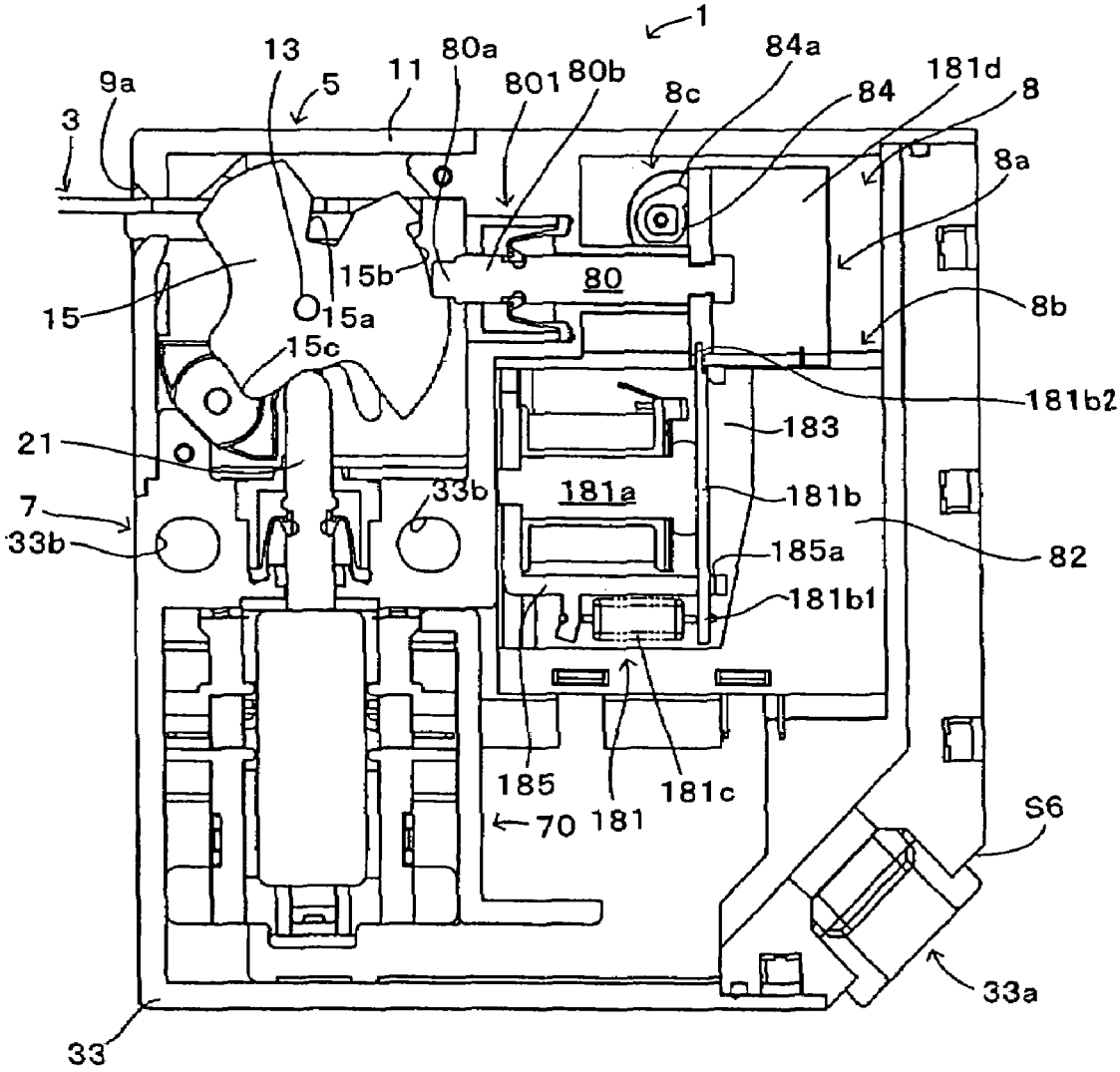
FIG. 11 is a sectional view of a switch body according to a third embodiment of the invention.
Figure 12A:
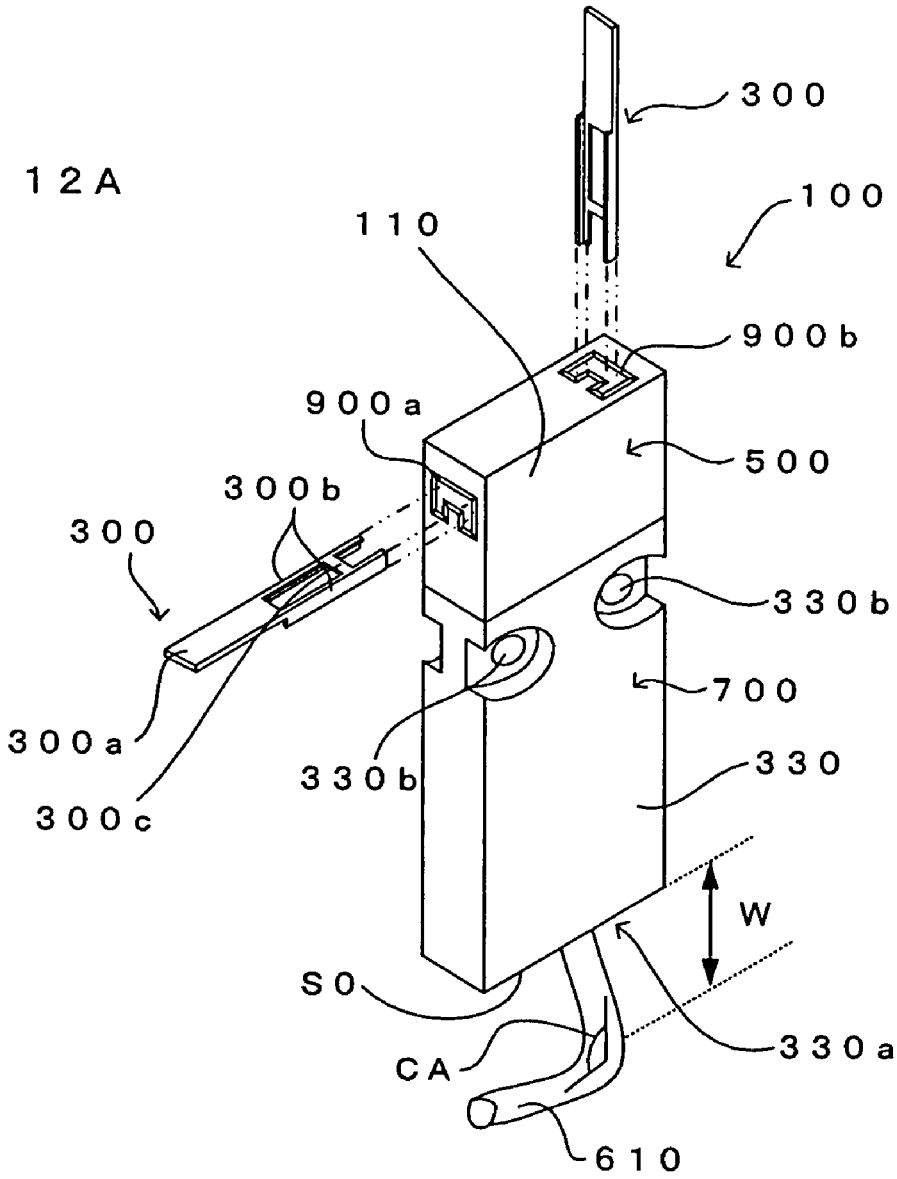
FIGS. 12A and 12B are a diagram showing a conventional safety switch.
Figure 12B:
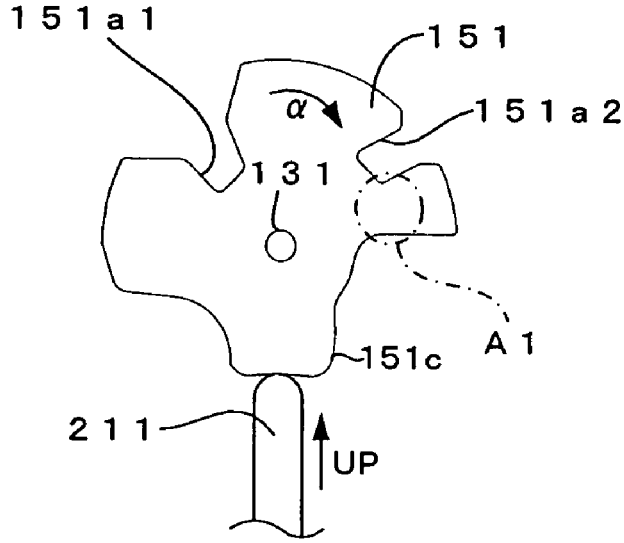
Figure 13A:
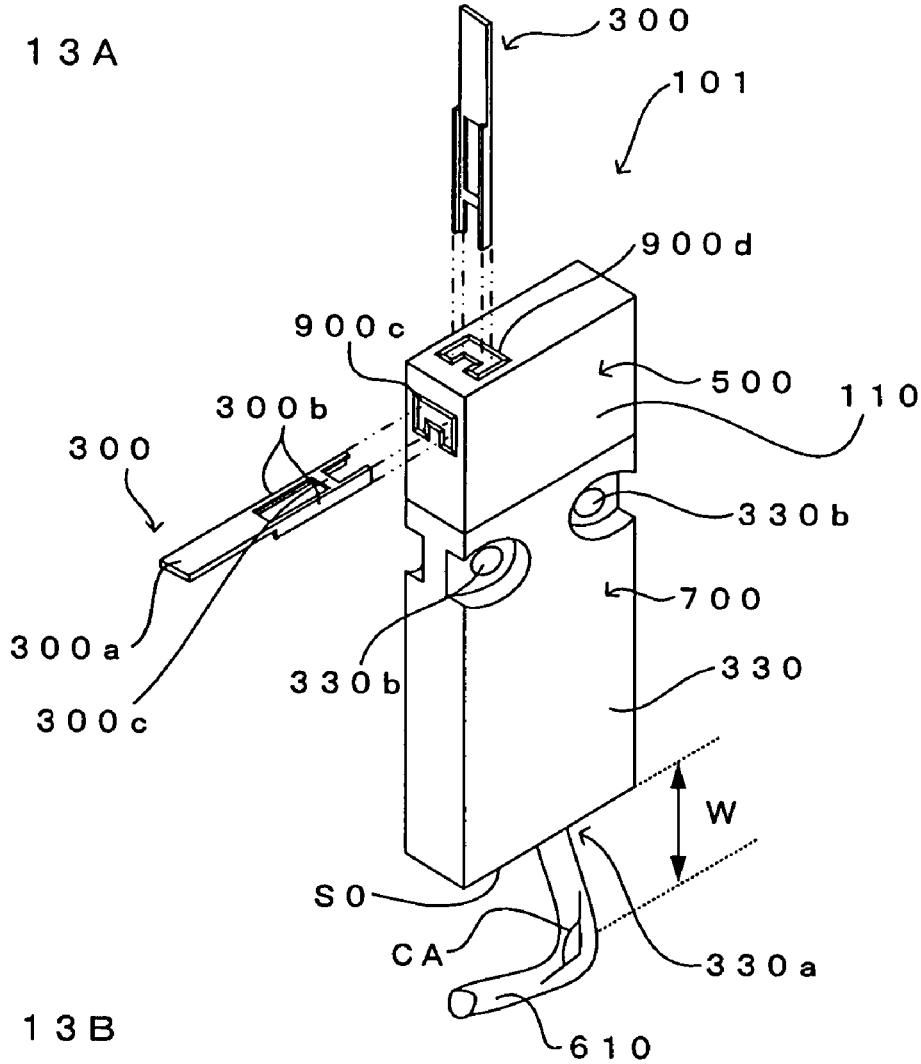
FIGS. 13A and 13B are a diagram showing another example of the conventional safety switch.
Figure 13B:
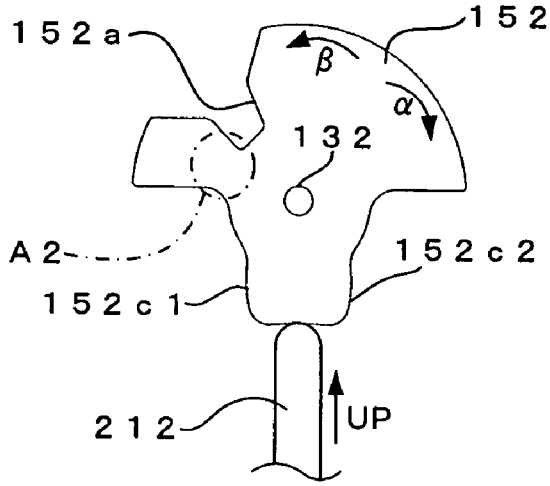

A third embodiment of the invention may be constituted as follows. As shown in FIG. 11, a driver 181 is provided which comprises: a hinge-shaped electromagnet 181*a* similar to the hinge-shaped electromagnet 81*a* of the first embodiment; a bias spring 181*c* comprising a coil spring or the like for biasing an upper end of an action body 181*b* rightward; and a link body 181*d* for transferring the displacement of the action body 181*b* to the lock body 80. The hinge-shaped electromagnet 181*a* is disposed as directing its center axis substantially in parallel to the moving direction of the lock body 80. The hinge-shaped electromagnet 181*a* is supported by the case 82 of a lock switching device portion 8*b* in a manner that a gap 183 is defined between the hinge-shaped electromagnet 181*a* and the case 82. The action body 181*b* and the bias spring 181*c* are disposed in the gap 183. The action body 181*b* has its lower end portion inserted through a through-hole 185*a* for connection with the bias spring 181*c*, the through-hole formed through a support frame 185 of the hinge-shaped electromagnet 181*a*.

An end of the lower end portion 181*b*1 of the action body 181 is connected with an end of the bias spring 181*c* anchored to the support frame 185 of the hinge-shaped electromagnet 181*a*. The biasing force of the bias spring 181*c* biases the lower end portion 181*b*1 leftward whereby an upper end portion 181*b*2 of the action body 181*b* is pivotally moved rightward about the through-hole 185*a* of the support frame 185 as a supporting point, or moved in the opposite direction to a direction in which the action body 181*b* is attracted by the energized hinge-shaped electromagnet 181*a*. The upper end portion 181*b*2 of the action body 181*b* is coupled (engaged) with the link body 181*d*, by which the lock body 80 is axially fixed.

If the hinge-shaped electromagnet 181*a* is un-energized, the action body 181*b* has its lower end portion 181*b*1 biased leftward by the bias spring 181*c* so as to be bodily biased into rightward movement. Thus, the upper end portion 181*b*2 is moved rightward. In conjunction with the rightward movement of the upper end portion 181*b*2, the link body 181*d* coupled with the upper end portion 181*b*2 is moved rightward so that the lock body 80 axially supported by the link body 181*d* is moved to the unlock position. On the other hand, if the hinge-shaped electromagnet 181*a* is energized, the electromagnetic attractive force of the hinge-shaped electromagnet 181*a* moves the action body 181*b* leftward to the electromagnet against the biasing force of the bias spring 181*c*. Consequently, the upper end portion 181*b* of the action body 181*b* is moved leftward or in the same direction as the direction of attraction by the hinge-shaped electromagnet 181*a*, as resisting the leftward biasing force of the bias spring 181*c*. In conjunction with the leftward movement of the upper end portion 181*b*2, the link body 181*d* coupled with the upper end portion 181*b*2 is moved leftward, so that the lock body 80 axially supported by the link body 181*d* is moved to the lock position (see FIG. 11).

Similarly to the first embodiment, the third embodiment employs the hinge-shaped electromagnet 181*a* smaller than a plunger-type electromagnet for moving the lock body 80 into or out of engagement with the lock portion 15*b* formed in the outer periphery of the driving cam 15. Hence, the safety switch may be downsized.

It goes without saying that the third embodiment may also employ a lock body unit similar to that of the second embodiment. An alternative constitution may be made such that the bias spring (biasing body) is disposed on the right side of the action body 181*b* for biasing the upper end portion 181*b*2 or the whole body of the action body 181*b* in the opposite direction to the direction of attraction by the energized hinge-shaped electromagnet 181*a* and that the hinge-shaped electromagnet 181*a* is energized to attract the upper end portion 181*b*2 or the whole body of the action body 181*b* against the biasing force of the bias spring 181*c*. The embodiment is not limited to the aforementioned constitutions but may adopt any constitution so long as the action body 181*b* is biased in the opposite direction to the direction of attraction by the energized hinge-shaped electromagnet 181*a*.

The invention is not limited to the foregoing embodiments and various changes or modifications may be made thereto within the scope of the invention. For instance, one of the normally-closed switching devices disposed in the switching device portion may be replaced by a normally-open switching device. In this case, the normally-closed switching device may be used for controlling the operation of the external apparatus, whereas the normally-open switching device may be used for obtaining the electrical signal based on which the entrance of the actuator is detected. According to such a constitution, the entrance of the actuator shifts the normally-closed switching device to the on state thereby enabling the disabled external apparatus to operate, whereas the normally-open switching device is shifted to the off state in conjunction with the entrance of the actuator. Thus, the entrance or retreat of the actuator as well as the status of the external apparatus may be externally determined by monitoring the on/off state of the normally-open switching device performing the opposite switching action to that of the normally-closed switching device.

Although the two normally-closed switching devices are provided in the foregoing embodiments, the number of switching devices is not limited to this. There may be provided one switching device or three or more than three switching devices may be provided. However, it is desirable to provide at least two normally-closed switching devices in order to enhance the reliability of the safety switch. Since the second normally-closed switching device 40 is so designed as to be changed to the normally-open switching device by exchanging the positions of the movable contact 40*a* and the stationary contact 40*b*, the switch portion 7 may be easily changed in the arrangement of switching devices according to applications.

In this case, the second normally-closed switching device 40 may be changed to the normally-open switching device by merely exchanging the positions of the movable contact 40*a* and the stationary contact 40*b*. The individual structures of the switching devices do not require special parts, contributing to cost reduction. What is more, the possibility of misassembling the parts, which results from the addition of the parts, may be eliminated. According to the foregoing embodiments, only the second normally-closed switching device 40 is designed as the switching device having the changeable switching structure. However, the number of switching devices having the changeable switching structure is not limited to this but is optional.

According to the first and second embodiments, the lock body 80 is moved to the lock position by way of the spring load (biasing force) of the bias spring 81*c* and is moved to the unlock position by way of the electromagnetic attractive force of the energized hinge-shaped electromagnet 81*a*. However, just as suggested by the third embodiment, the lock body 80 may be moved to the lock position by way of the electromagnetic attractive force, thereby locking the lock mechanism 8*a*. In this case, it is desirable to provide a bias spring applying a biasing force to move the lock body 80 to the unlock position. As a matter of course, the third embodiment may also be constituted to move the lock body 80 to the lock position by way of the spring load of the bias spring, just as suggested by the first and second embodiments.

According to the first and third embodiments, the electromagnetic attractive force of the hinge-shaped electromagnet is transferred to the lock body via the link body 81*d* (transfer portion). An alternative constitution may of course be made such that the link body 81*d* is omitted and the action body 81*b* is directly engaged with the lock body 80 for transferring the electromagnetic attractive force of the hinge-shaped electromagnet to the lock body 80. Otherwise, a constitution may be made such that the displacement of the action body 81*b* is transferred to the link body 81*d* and the movable contacts 85*a*, 86*a* via the lock body 80.

According to the first and second embodiments, the upper end portion 81*b*2 (second side) of the action body 81*b* is biased by the bias spring 81*c*. However, a constitution may of course be made such that the lower end portion 81*b*3 (first side) of the action body is biased. Further, a coil spring may be used as the biasing body in place of the bias spring 81*c* comprising the leaf spring.

While the foregoing first to third embodiments have been described by way of example where the fixing member 105 is used as the "fixing member" of the invention, the "fixing member" is not limited to this. As a matter of course, the wall surface around the protective door to the industrial machines, for example, may be used as the "fixing member" of the invention. In short, the "fixing member" of the invention may be any thing to which the switch body can be fixedly attached.

While the foregoing embodiments illustrate the safety switch equipped with the lock mechanism, the safety switch may of course have a constitution without the lock mechanism.

It is noted that the invention is not limited to the foregoing embodiments and various changes or modifications may be made thereto so long as such changes or modifications do not depart from the scope of the invention. The invention may find wide ranging applications wherein the safety of workers is ensured by disabling the machines when the protective door is not completely closed.

The invention claimed is:

1. A safety switch system for mounting on a support member surface defining a support member plane, comprising:

a switch body configured to be removably attachable to the support member, said switch body including an operation portion and a switch portion connected together;

said operation portion having exposed surfaces which include one actuator opening providing access to a driving cam, said exposed surfaces of the operation portion being absent actuator openings other than said one actuator opening;

an actuator configured to be insertable and removable by a user into and from the one actuator opening of the operation portion to rotate the driving cam in first and second directions;

the switch portion having a switching device and an operating rod translating rotation motion of said driving cam to operate the switching device between an off state and an on state based on insertion and removal of the actuator;

said switch body having a rectangular solid shape having six planar side surfaces including a first pair of surfaces including first and second opposing side surfaces, a second pair of surfaces including third and fourth opposing side surfaces, and third pair of surfaces including fifth and sixth opposing side surfaces, the first, second and third pairs of surfaces being disposed orthogonal to each other;

said first side surface including a portion of the exposed surfaces of the operation portion and said actuator opening, said actuator opening being disposed at a first corner portion of the rectangular solid shape;

the rectangular solid shape being modified by an excised second corner portion such that a recessed surface is presented in addition to said first, second and third pairs of surface, the recessed surfaces being an outermost exterior surface of the rectangular solid shape at a location of the excised second corner portion and positioned diagonally opposite said first corner portion in a direction diagonally across said fifth and sixth opposing side surfaces;

said recessed surface defining a cable lead-out port positioned recessed relative to each of four planes defined by said second opposing side surface, said fourth opposing side surface, said fifth opposing side surface and said sixth opposing side surface; and a cable entering said switch portion via said cable lead-out port, said cable lead-out port being sufficiently recessed relative to said four planes such that the switch body is mountable with any of said second, third, fourth, fifth and sixth opposing side surfaces against said support member without said cable passing through said support member plane.

2. The safety switch system according to claim 1, wherein said recessed surface is a slanted planar surface defining oblique angles in conjunction with said second and fourth opposing side surfaces.

3. A safety switch system for mounting on a support member surface defining a support member plane, the safety switch system being configured to accept a cable for connection to a controlled device, comprising:

a switch body configured to be removably attachable to the support member, said switch body including an operation portion and a switch portion connected together;

said operation portion having exposed surfaces which include one actuator opening providing access to a driving cam, said exposed surfaces of the operation portion being absent actuator openings other than said one actuator opening;

an actuator configured to be insertable and removable by a user into and from the one actuator opening of the operation portion to rotate the driving cam in first and second directions;

the switch portion having a switching device and an operating rod translating rotation motion of said driving cam to operate the switching device between an off state and an on state based on insertion and removal of the actuator;

said switch body having a rectangular solid shape having six planar side surfaces including a first pair of surfaces including first and second opposing side surfaces, a second pair of surfaces including third and fourth opposing side surfaces, and third pair of surfaces including fifth and sixth opposing side surfaces, the first, second and third pairs of surfaces being disposed orthogonal to each other;

said first side surface including a portion of the exposed surfaces of the operation portion and said actuator opening, said actuator opening being disposed at a first corner portion of the rectangular solid shape;

the rectangular solid shape being modified by an excised second corner portion such that a recessed surface is presented in addition to said first, second and third pairs of surface, the recessed surfaces being an outermost exterior surface of the rectangular solid shape at a location of the excised corner portion and positioned diagonally opposite said first corner portion in a direction diagonally across said fifth and sixth opposing side surfaces; and said recessed surface defining a cable lead-out port positioned recessed relative to each of four planes defined by said second opposing side surface, said fourth opposing side surface, said fifth opposing side surface and said sixth opposing side surface, the cable-lead out port being configured to accept the cable for connection to said switch device, said cable lead-out port being sufficiently recessed relative to said four planes such that the switch body is mountable with any of said second, third, fourth, fifth and sixth opposing side surfaces against said support member without said cable passing through said support member plane.

4. The safety switch system according to claim 3, wherein said recessed surface is a slanted planar surface defining oblique angles in conjunction with said second and fourth opposing side surfaces.

5. A safety switch system for mounting on a support member surface defining a support member plane, the safety switch system being configured to accept a cable for connection to a controlled device, comprising:

a switch body housing a driving cam that is rotatably mounted, an operating rod, and a switching device;

said driving cam having a curved cam surface and an actuator engagement surface, both disposed on an outer periphery of the driving cam;

said switch body having a rectangular configuration and an entire exterior which includes one actuator opening disposed at a first corner portion of the switch body and providing access to a driving cam, said entire exterior of the switch body being absent actuator openings other than said one actuator opening;

an actuator configured to be insertable and removable by a user into and from the one actuator opening to engage the actuator engagement surface to rotate the driving cam in first direction during insertion and a second direction during removal;

said operating rod being slidably mounted to effect translation of rotation motion of said driving cam by displacement by said curved cam surface to operate the switching device between an off state and an on state based on insertion to removal of the actuator, said curved cam surface extending from a first position on the driving cam engaged by the operating rod when the actuator is not inserted and a second position on the driving cam engaged by the operating rod when the actuator is fully inserted;

said exterior of said switch body defining a cable lead-out port positioned at a second corner portion of the switch body which is located opposite said first corner portion; and said driving cam being absent curved cam surfaces engageable by said operation rod other than said curved cam surface, and said driving cam being absent engagement surfaces oriented to engage the actuator other than said actuator engagement surface.

6. The safety switch system according to claim 5, wherein:

said rectangular configuration of said switch body has six planar side surfaces, and a slanted planar surface at an excised corner portion, in addition to said six planar side surfaces, is provided, said slanted planar surface defining oblique angles in conjunction with a first orthogonal pair of said six planar surfaces adjacent said slanted planar surface;

said actuator opening is formed in a first planar side surface, other than said first orthogonal pair of side surfaces, in a corner portion located diagonally opposed to said excised corner portion and said slanted planar surface; and said cable lead-out port is defined in said slanted planar surface.

7. The safety switch system according to claim 5, wherein:

the switch body configured to be removably attachable to the support member;

said rectangular configuration has six planar side surfaces including a first pair of surfaces including first and second opposing side surfaces, a second pair of surfaces including third and fourth opposing side surfaces, and third pair of surfaces including fifth and sixth opposing side surfaces, the first, second and third pairs of surfaces being disposed orthogonal to each other;

said actuator opening is in the first opposing side surface; and said rectangular configuration being modified so as to have an excised corner portion forming a recessed surface in addition to said six planar side surfaces, said recessed surface defining a cable lead-out port positioned recessed relative to each of four planes defined by said second opposing side surface, said fourth opposing side surface, said fifth opposing side surface and said sixth opposing side surface, the cable-lead out port being configured to accept the cable for connection to said switch device, said cable lead-out port being sufficiently recessed relative to said four planes such that the switch body is mountable with any of said second, third, fourth, fifth and sixth opposing side surfaces against said support member without said cable passing through said support member plane.

8. A safety switch system comprising:

a switch body removably attachable to a fixing member, an actuator free to enter or retreat from an operation portion of said switch body, a driving cam free to rotate in said operation portion, wherein:

said actuator is engage with an engaging portion of said driving cam so as to rotate said driving cam in either direction depending upon the entrance or retreat of said actuator, the rotation of said driving cam in either direction causes an operating rod disposed in a switch portion of said switch body to reciprocate as sliding on a cam curve portion of said driving cam, thereby shifting a switching device of said switch portion between an off state and an on state based on which the entrance or retreat of said actuator is detected, said switch body has a rectangular solid shape, only one actuator entrance hole is formed at one peripheral surface constituting one corner potion of said switch body, and peripheral surface included in six outside surfaces of said switch body, a cable lead-out port of a cable connected to said switching device of said switch portion is formed at the other corner potion opposite said one corner portion of said switch body, only one engaging portion is formed on an outer peripheral surface of said driving cam, and only one cam curve portion is formed on an outer peripheral surface of said driving cam from a position at which said operating rod contacts when said actuator is completely retreated to a position at which said operation rod contacts when said actuator is completely entered.

9. The safety switch system according to claim 8, wherein a slant surface is formed at said opposite corner portion of said switch body, as inclined to two peripheral surfaces constituting said opposite corner portion, said two peripheral surfaces included in the six outside surfaces of said switch body, and wherein said cable lead-out port is formed at said slant surface.

10. The safety switch system according to claim 8, wherein any one of the five outside surfaces of said switch body except for said peripheral surface formed with said actuator entrance hole is used as a mounting surface to said fixing member.

* * * * *